US011675310B2

(12) United States Patent
Doi

(10) Patent No.: US 11,675,310 B2
(45) Date of Patent: Jun. 13, 2023

(54) IMAGE FORMING APPARATUS TO COOL A CIRCUIT BOARD INSIDE A DUCT

(71) Applicant: CANON KABUSHIKI KAISHA, Tokyo (JP)

(72) Inventor: Shigeo Doi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/544,770

(22) Filed: Dec. 7, 2021

(65) Prior Publication Data

US 2022/0187764 A1 Jun. 16, 2022

(30) Foreign Application Priority Data

Dec. 14, 2020 (JP) ..... JP2020-207102

(51) Int. Cl.
*G03G 21/00* (2006.01)
*G03G 21/20* (2006.01)
*G03G 15/00* (2006.01)

(52) U.S. Cl.
CPC ..... *G03G 21/206* (2013.01); *G03G 15/80* (2013.01); *G03G 2221/1645* (2013.01)

(58) Field of Classification Search
CPC .. G03G 15/80; G03G 15/2021; G03G 21/206; G03G 2221/1645
USPC ..... 399/88, 92, 341
See application file for complete search history.

(56) References Cited

U.S. PATENT DOCUMENTS 6,415,118 B1 * 7/2002 Setoriyama ..... G03G 15/00 399/92
7,558,060 B2 * 7/2009 Kiyosumi ..... B41J 2/1408 399/92
9,671,753 B2 * 6/2017 Yamashita ..... G03G 21/206
2004/0228646 A1 * 11/2004 Sekiguchi ..... G03G 21/206 399/92
2016/0070231 A1 * 3/2016 Kobayashi ..... G03G 21/206 399/92
2016/0209806 A1 * 7/2016 Shiomi ..... G03G 21/206
2017/0153598 A1 * 6/2017 Satou ..... G03G 21/206
2019/0307013 A1 * 10/2019 Hashizume ..... H05K 7/20909

FOREIGN PATENT DOCUMENTS

EP 2586619 A1 * 5/2013 ..... B41J 13/103
JP 2003228260 A 8/2003

* cited by examiner

*Primary Examiner* — Robert B Beatty
(74) *Attorney, Agent, or Firm* — Canon U.S.A., Inc. I.P. Division

(57) ABSTRACT

An image forming apparatus includes a support frame, a cover, an electric component unit, a duct unit, and a fan. The support frame includes a second support portion disposed more rearward than a first support portion in a front-back direction of the image forming apparatus. The cover is more rearward than the second support portion in the front-back direction, and forms part of an image forming apparatus exterior. The electric component unit has a circuit board, and is between the second support portion and the cover in the front-back direction. The duct unit has an intake port located more frontward than the second support portion in the front-back direction, and is connected to the electric component unit. The fan is more rearward than the second support portion in the front-back direction, and takes in air from the intake port and discharge the air from an electric component unit exhaust port.

16 Claims, 14 Drawing Sheets

102
200Y,200M,200C
200K
201Y,201M,201C
202Y,202M,202C
204Y,204M,204C
209Y,209M,209C
201K
202K
204K
209K
219
Z
Y
X
205Y
203Y
206M
206Y
200Y
205M
203M
205C
203C
206C
200M
207M
200C
207C
205K
203K
206K
200K
207K
208
213
214
215
216
218
217b
217a
207Y
210
211
212
S

IMAGE FORMING APPARATUS TO COOL A CIRCUIT BOARD INSIDE A DUCT

BACKGROUND

Field

The present disclosure relates to electrophotographic image forming apparatuses such as a copier, a printer, a facsimile, and a multi-function machine having a plurality of functions including these functions.

Description of the Related Art

A conventional image forming apparatus contains various units such as an image formation unit for forming a toner image, a fixing unit for fixing toner to a sheet by heating the toner, and a power supply unit for supplying power to the entire apparatus, and these various units can generate heat accompanying the operation of the apparatus. Therefore, in general, there is employed a configuration in which an air blowing fan is disposed to form an airflow, so that the heat of each unit is released by discharging air taken in from each unit to the outside of the apparatus via an exhaust port.

Japanese Patent Application Laid-Open No. 2003-228260 discusses an image forming apparatus in which an intake fan is disposed on the rear face side of the image forming apparatus, an airflow is formed to cool a photosensitive member serving as a cooling target, and the air of the airflow is discharged to the rear face side of the image forming apparatus via a duct, so that the inside of the apparatus is cooled.

In recent years, electrophotographic image forming apparatuses spreading from office uses to commercial printing have increased in size accompanying higher production, higher image quality, higher stability, longer life, and higher functionality, and power consumption has been increasing as well. As the power consumption increases, the amount of heat generation in an electric component unit having a circuit board such as a power supply unit disposed inside the image forming apparatus also increases, and therefore, it may be desirable to provide an air blowing fan for discharging the heat of the electric component unit.

Here, if an airflow using both of an intake port and an exhaust port disposed on the rear face side of the image forming apparatus is formed to cool the electric component unit as discussed in Japanese Patent Application Laid-Open No. 2003-228260, air passing the electric component unit can be taken in from the intake port. The air passing the electric component unit is warmed by heat generated by the electric component unit, and therefore, if this air is taken in from the intake port, the cooling efficiency of the electric component unit can decrease.

SUMMARY

The present disclosure is directed to efficiently cooling an electric component unit having a circuit board.

According to an aspect of the present disclosure, an image forming apparatus to form an image on a sheet includes a support frame having a first support portion and a second support portion disposed more rearward than the first support portion in a front-back direction of the image forming apparatus, a cover disposed more rearward than the second support portion in the front-back direction, and forming at least a part of an exterior of the image forming apparatus, an electric component unit having a circuit board, and disposed between the second support portion and the cover in the front-back direction, a duct unit having an intake port located more frontward than the second support portion in the front-back direction, and connected to the electric component unit, and a fan disposed more rearward than the second support portion in the front-back direction, and configured to form an airflow to take in air from the intake port and discharge the air from an exhaust port of the electric component unit.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings. The dimensions, materials, and shapes of components described in the following exemplary embodiments, the relative positions of these components, and the like are to be appropriately modified depending on the configuration and various conditions of an apparatus to which the present disclosure is applied, and are not intended to limit the scope of the present disclosure.

(Image Forming System)

Figure 1:
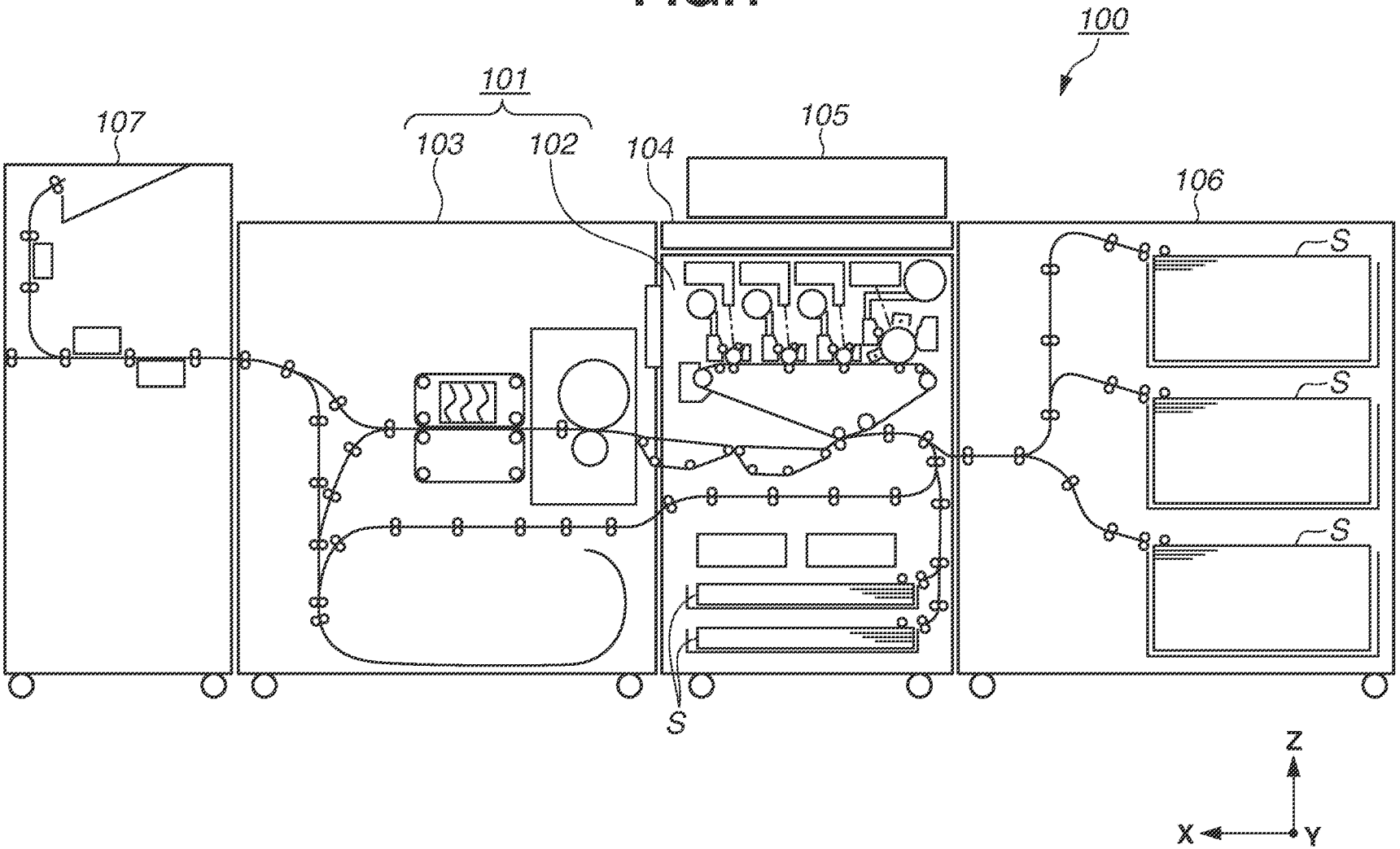
FIG. 1 is a schematic cross-sectional view of an image forming system including an image forming apparatus.

FIG. 1 is a schematic cross-sectional view of an image forming system 100 including an image forming apparatus 101 according to an exemplary embodiment of the present disclosure. The image forming apparatus 101 illustrated in FIG. 1 includes an image forming unit 102 that transfers a toner image to a fed sheet S, and a fixing conveyance unit 103 that fixes the transferred toner image to the sheet S. The image forming unit 102 and the fixing conveyance unit 103 are each configured in an independent housing. This configuration makes it possible to pack and transport each of the housings in a separate state even if the apparatus is large in size, so that workability in distribution before installation can be improved.

A document reader 104 for reading a document image and a document feeder 105 for feeding a plurality of stacked documents one by one to the document reader 104 are selectively connected to the top of the image forming unit 102.

Any of a large-capacity sheet feeding apparatus 106 having a plurality of sheet storage units, a manual sheet feeding apparatus (not illustrated), and a long sheet feeding apparatus (not illustrated) that can contain long sheets can be selectively connected to the upstream side of the image forming unit 102 in a sheet conveyance direction (an arrow-X direction). Any of a large-capacity sheet feeding apparatus, a manual sheet feeding apparatus, and a long sheet feeding apparatus (none of these is illustrated) can be further selectively connected to the upstream side of the large-capacity sheet feeding apparatus 106.

A sensing apparatus 107 is selectively connected to the downstream side of the fixing conveyance unit 103 in the sheet conveyance direction (the arrow-X direction). The sensing apparatus 107 is provided to read a fixed toner image formed on one side or each of both sides of the sheet S, detect image density and misalignment of an image position, and perform feedback correction for an image signal to be transmitted to the image forming unit 102.

One or a combination of some of various sheet processing apparatuses (not illustrated) including an inserter, a puncher, a case binder, a large-capacity stacker, a folding machine, a finisher, and a trimmer can be connected to the downstream side of the fixing conveyance unit 103 or further to the downstream side of the sensing apparatus 107.

As described above, in the image forming apparatus 101 of the present exemplary embodiment, various optional apparatuses are selectively connected to the upstream and downstream sides in the sheet conveyance direction, so that products obtained by subjecting various materials to various types of post processing can be output in a line. Therefore, the image forming system 100 superior in terms of high production, high image quality, high stability, and high functionality can be provided.

(Image Forming Apparatus: Image Forming Unit 102)

Figures 2A, 2B, 2C:
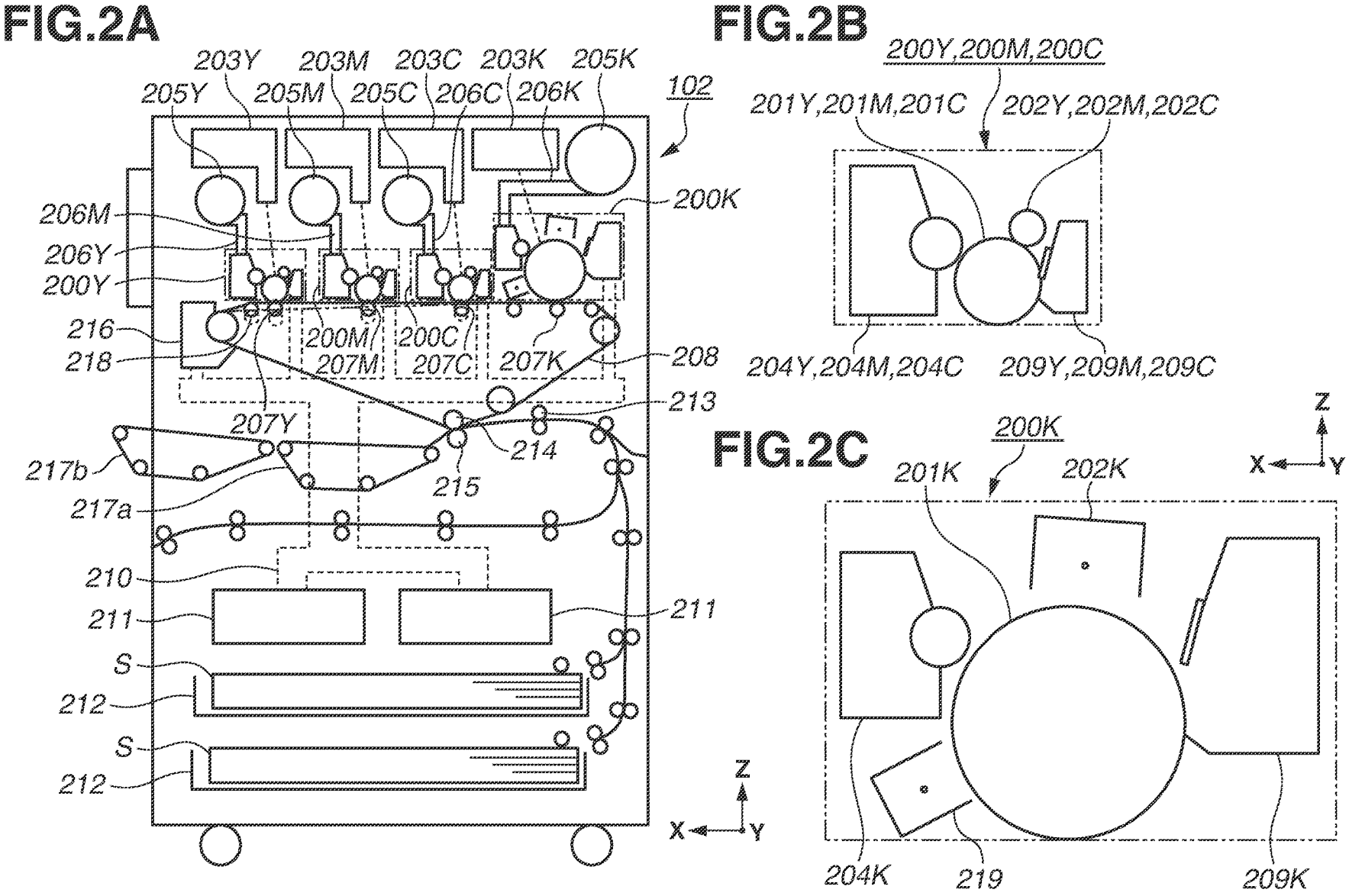
FIGS. 2A to 2C are schematic cross-sectional views of an image forming unit of the image forming apparatus.

FIGS. 2A to 2C are schematic cross-sectional views of the image forming unit 102 in the image forming apparatus 101 of the present exemplary embodiment. The image forming unit 102 illustrated in FIGS. 2A to 2C includes a plurality of image formation stations 200 (image formation stations 200Y, 200M, 200C, and 200K) for forming toner images of different colors of yellow (Y), magenta (M), cyan (C), and black (K). These image formation stations 200 are examples of an image formation unit. FIG. 2A is a schematic cross-sectional view of the entire image forming unit 102. FIG. 2B is a schematic cross-sectional view of each of the image formation stations 200Y, 200M, and 200C. FIG. 2C is a schematic cross-sectional view of the image formation station 200K.

As illustrated in FIGS. 2A to 2C, an electrostatic latent image is formed on a photosensitive drum 201 in each of the image formation stations 200 by a laser scanner 203 driven based on a transmitted image information signal, after the surface of the photosensitive drum 201 is uniformly charged by a primary charger 202. The formed latent image is developed as a toner image by a development device 204. The toner used by the development is appropriately supplied from a toner bottle 205 to each of the development devices 204 via a toner supply path 206. The image formation stations 200Y, 200M, and 200C only vary in the color of the toner to be used and all have similar configurations. In the following, the characters Y, M, C, and K may be omitted in the description of the similar configurations. A part of the configuration of the image formation station 200K has a different function from those of the image formation stations 200Y, 200M, and 200C, and thus the different part will be described below.

A predetermined pressing force and an electrostatic load bias are applied to the toner image on the photosensitive drum 201 by a primary transfer roller 207, so that the toner images are sequentially transferred onto an intermediate transfer belt 208. A small amount of residual toner on the photosensitive drum 201 after the transfer is removed by a photosensitive drum cleaner 209, so that the photosensitive drum 201 is ready for the next image formation. The removed residual toner is collected into a collected-toner container 211 via a toner collection path 210.

Meanwhile, the sheets S are fed one by one from either the sheet storage unit 212 in the image forming unit 102 or any of the above-described sheet feeding apparatuses externally connected to the image forming apparatus 101, and the leading end of each of the fed sheets S forms a loop along a nip portion of a registration roller 213, so that skew correction is performed. Afterward, the registration roller 213 conveys the sheet S to a secondary transfer portion in synchronization with the toner images on the intermediate transfer belt 208.

The toner images on the intermediate transfer belt 208 are transferred to the sheet S by applying a predetermined pressing force and an electrostatic load bias thereto at a secondary transfer nip formed by a secondary transfer inner roller 214 and a secondary transfer outer roller 215. A small amount of residual toner on the intermediate transfer belt 208 after the transfer is removed by an intermediate transfer belt cleaner 216, so that the intermediate transfer belt 208 is ready for the next image formation. The removed residual toner is collected into the collected-toner container 211 via the toner collection path 210. The sheet S onto which the toner images are transferred is conveyed by pre-fixing conveyance belts 217*a* and 217*b* to the fixing conveyance unit 103 located downstream.

(Image Forming Apparatus: Monochrome Image Formation)

The image forming apparatus 101 of the present exemplary embodiment can perform monochrome image formation using only the image formation station 200K, in addition to the above-described full-color image formation using all of the image formation stations 200Y, 200M, 200C, and 200K.

In the monochrome image formation, the primary transfer rollers 207Y, 207M, and 207C, a primary transfer auxiliary roller 218, and the intermediate transfer belt 208 are each shifted to a position indicated by a broken line in FIG. 2A, by a separation mechanism (not illustrated). This separation mechanism can stop the rotational driving of the image formation stations 200Y, 200M, and 200C separated from the intermediate transfer belt 208. In other words, in the image formation stations 200Y, 200M, and 200C, unnecessary component abrasion accompanying unnecessary rotational driving can be prevented, so that the life can be increased.

Meanwhile, the photosensitive drum 201K is configured to have a large diameter more suitable for a long life than those of the photosensitive drums 201Y, 201M, and 201C. In addition, as illustrated in FIG. 2C, the primary charger 202K is configured to employ a contactless charging method using a corona charger that is more suitable for a long life than a contact charging method using a roller charger in each of the primary chargers 202Y, 202M, and 202C. Further, the toner bottle 205K is configured as a large-capacity bottle more suitable for a long life than the toner bottles 205Y, 205M, and 205C.

Thanks to the above-described configurations, for a user who frequently uses the monochrome image formation mode, it is possible to prevent a reduction in the maintenance interval of the image formation station 200K frequently used, as compared with the image formation stations 200Y, 200M, and 200C less frequently used.

In addition, the large diameter drum configuration using the corona charger (the primary charger 202K) has a broad charge width and is suitable for speedup as compared with the small diameter drum configuration using the roller charger (each of the primary chargers 202Y, 202M, and 202C), and thus productivity in the monochrome image formation can be improved.

In the image forming unit 102 having such conditions varying among the image formation stations 200, a difference in toner charge amount on the photosensitive drum 201 can occur because of a difference in shape and abrasion amount. If such a difference in the toner charge amount occurs, uniform transfer of the toner images to the sheet S can be hindered and an image defect can occur in the secondary transfer process. Therefore, the photosensitive drum 201K includes a pre-transfer charger 219 consisting of a corona charger to make the toner charge amount equal to those of the photosensitive drums 201Y, 201M, and 201C.

As described above, according to the configuration of the present exemplary embodiment, the image forming apparatus 101 superior in terms of high production, high image quality, high stability, and long life can be provided not only in the full-color image formation but also in the monochrome image formation.

(Image Forming Apparatus: Fixing Conveyance Unit 103)

Figure 3:
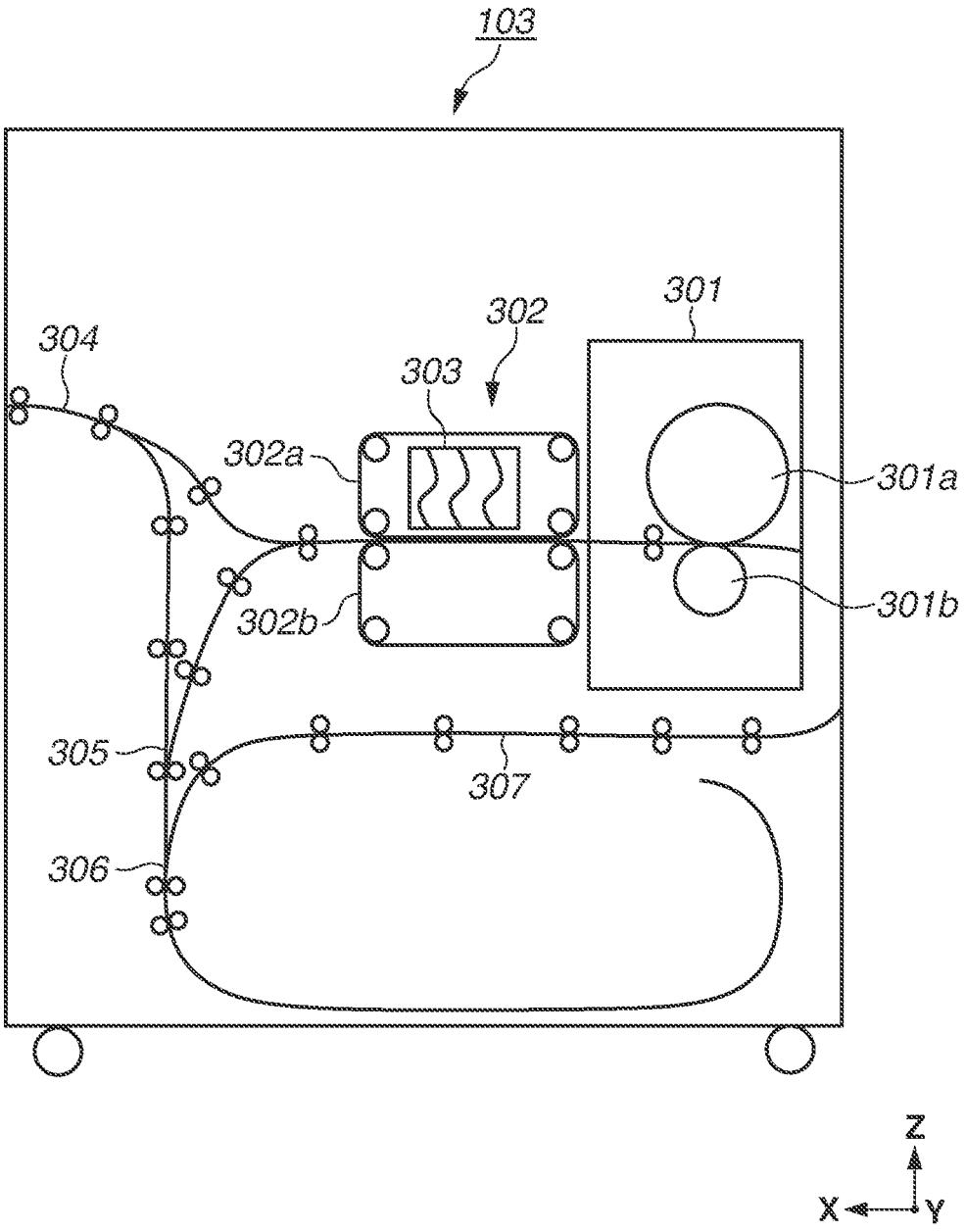
FIG. 3 is a schematic cross-sectional view of a fixing conveyance unit of the image forming apparatus.

FIG. 3 is a schematic cross-sectional view of the fixing conveyance unit 103 in the image forming apparatus 101 of the present exemplary embodiment. A fixing unit 301 illustrated in FIG. 3 heats and presses the toner images on the sheet S conveyed by the image forming unit 102, thereby fixing the toner images onto the sheet S.

In the present exemplary embodiment, the fixing unit 301 has a heating roller 301*a* disposed on the upper side in the vertical direction to be heated by a heater (not illustrated), and a pressing roller 301*b* disposed on the lower side in the vertical direction to press a sheet against the heating roller 301*a*. The sheet S where the toner images are formed is heated and pressed at a fixing nip formed by the heating roller 301*a* and the pressing roller 301*b*, so that the toner images are fixed to the sheet S. The heating roller 301*a* and the pressing roller 301*b* hold and convey the sheet S downstream in the sheet conveyance direction, while heating and pressing the sheet S. Here, the fixing unit 301 consisting of the pair of rollers is described as an example, but the fixing unit 301 may be a unit for forming a fixing nip using a conveyance belt.

The sheet S heated by the fixing unit 301 is held and conveyed by a pair of conveyance belts 302*a* and 302*b*, while being cooled by heat absorption by a heat sink 303 in contact with an inner circumferential surface of the conveyance belt 302*a* of a cooling unit 302. The sheet S is then discharged to the sensing apparatus 107 described above or a post-processing apparatus (not illustrated), via a sheet discharge conveyance path 304.

In a case where the sheet S is to be discharged after the front and the back of the sheet S are reversed, switchback conveyance is performed by a sheet-discharge reverse portion 305, so that the sheet S in a state where the leading end and the trailing end are replaced with each other and the front and the back are reversed is discharged via the sheet discharge conveyance path 304.

In a case where the image formation is to be performed for both sides of the sheet S, the sheet S having an image formed on the first side is switched back and conveyed by a two-sided reverse portion 306, so that the sheet S in a state where the leading end and the trailing end are replaced with each other and the front and the back are reversed is conveyed to a two-sided printing conveyance path 307. Afterward, the sheet S reaches the registration roller 213 again at the right timing not to coincide with the subsequent sheet S fed from the sheet storage unit 212 in the image forming unit 102 or from any one of the externally connected sheet feeding apparatuses described above, and the image formation is performed for the second side in a process similar to that for the first side. Subsequently, the sheet S is discharged via the sheet discharge conveyance path 304.

(Image Forming Apparatus: Airflow Arrangement)

Figure 4:
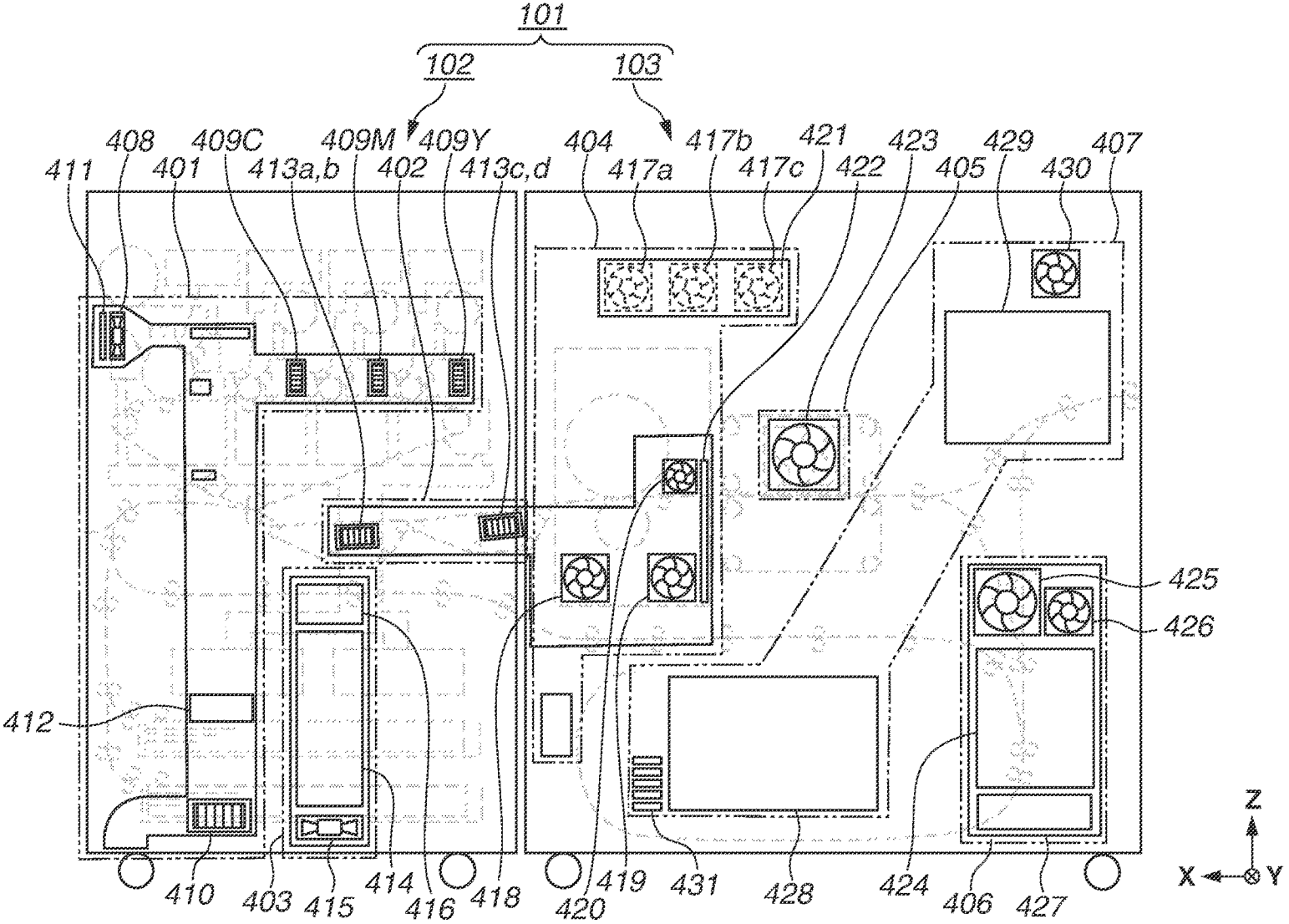
FIG. 4 is a rear view of an airflow arrangement of the image forming apparatus.

FIG. 4 illustrates an airflow arrangement in the image forming apparatus 101 of the present exemplary embodiment, and this is a view when the image forming apparatus 101 is viewed from the rear face side. Here, the front face of the image forming apparatus 101 is a surface at which the sheet storage unit 212 is drawn from the image forming apparatus 101 when, for example, sheets are added to the sheet storage unit 212, and a user operating the image forming apparatus 101 stands in front of this surface.

The rear face of the image forming apparatus 101 is a surface opposite to the front face in the front-back direction (a direction for inserting/removing the sheet storage unit 212).

As illustrated in FIG. 4, the image forming apparatus 101 includes a duct unit for forming each of an image formation airflow 401, a pre-fixing conveyance airflow 402, and a power source airflow 403. The fixing conveyance unit 103 includes a duct unit for forming each of a fixing airflow 404, a cooling unit airflow 405, a power source airflow 406, and an electric component airflow 407.

The image formation airflow 401 of the image forming unit 102 is provided with a primary charger intake fan 408, development device intake fans 409Y, 409M, and 409C, and an image formation exhaust fan 410.

The primary charger intake fan 408 supplies outside air for ventilation to the primary charger 202K of the image formation station 200K. Disposed upstream from the primary charger intake fan 408 is a primary charger air filter 411 for collecting dust floating in the outside air and supplying the purified air to the primary charger 202K.

The development device intake fans 409Y, 409M, and 409C supply outside air for cooling to the development devices 204Y, 204M, and 204C.

The image formation exhaust fan 410 discharges ozone released from the primary charger 202K and the pre-transfer charger 219 by corona discharge, from the image formation station 200K. Further, the image formation exhaust fan 410 discharges heat released from each of the development devices 204 by friction in rotational driving, from each of the image formation stations 200. Furthermore, the image formation exhaust fan 410 discharges remaining heat from inside the toner collection path 210. Moreover, the image formation exhaust fan 410 discharges a minute amount of floating toner released in each process of the toner image formation, from each of the image formation stations 200. Disposed upstream from the image formation exhaust fan 410 is an image formation exhaust filter 412 for collecting ozone and dust including toner discharged from each of the image formation stations 200, and discharging the purified air to the outside of the image forming apparatus 101.

According to the above-described configuration of the image formation airflow 401, the ozone, heat, and dust released in the image formation processes can be efficiently discharged without being held inside each of the image formation stations 200, and can be collected by the image formation exhaust filter 412.

In other words, it is possible to prevent charge image defects such as charge unevenness caused by the attachment of ozone and dust to the photosensitive drum 201 and the primary charger 202, development image defects caused by fluidity deterioration attributable to an excessive increase in the temperature of toner, a malfunction such as clogging in a toner conveyance path, and transfer image defects caused by the attachment of ozone and dust to the pre-transfer charger 219.

Therefore, the image forming apparatus 101 superior in terms of high image quality, high stability, and long life can be provided. In addition, the image forming apparatus 101 superior in terms of environmental friendliness by reducing the amount of discharge of ozone and dust to the outside of the image forming apparatus 101 can be provided.

Disposed in the inner peripheral part of each of the pre-fixing conveyance belts 217*a* and 217*b* is a pre-fixing conveyance suction fan 413 for making the sheet S stick to the outer peripheral surface of each of the pre-fixing conveyance belts 217*a* and 217*b* by suction via an intake port (not illustrated) in each of the pre-fixing conveyance belts 217*a* and 217*b*. The two pre-fixing conveyance suction fans 413 are disposed at the front and the rear for each of the pre-fixing conveyance belts 217*a* and 217*b*, i.e., the four pre-fixing conveyance suction fans 413*a* to 413*d* in total are disposed. In this way, the pre-fixing conveyance suction fans 413 form the pre-fixing conveyance airflow 402 of the image forming unit 102.

The pre-fixing conveyance suction fan 413 performs adjustment to an optimum air quantity by a control circuit (not illustrated), depending on the material and shape of the sheet S to be conveyed. According to this configuration, it is possible to perform stable conveyance for various materials without disturbing the unfixed toner images on the sheet S. Therefore, the image forming apparatus 101 superior in terms of high image quality, high stability, and high functionality can be provided.

There is a possibility that the pre-fixing conveyance suction fan 413 draws heat, volatile organic compound (VOC), dust, and ultrafine particle (UFP) released by the adjacent fixing unit 301. Therefore, the pre-fixing conveyance airflow 402 collects VOC, dust, and UFP using a fixing lower exhaust filter 422 to be described below, and discharges the purified air to the outside of the image forming apparatus 101. This configuration makes it possible to provide the image forming apparatus 101 superior in terms of environmental friendliness by reducing the amount of discharge of VOC, dust, and UFP to the outside of apparatus 101.

The power source airflow 403 of the image forming unit 102 is provided with a power source exhaust fan 415 for discharging heat released by a power source circuit board 414 to the outside of the image forming apparatus 101. Accompanying the exhaust by the power source exhaust fan 415, outside air for cooling is supplied from a power source intake port 416, so that the power source circuit board 414 can be efficiently cooled. This configuration can prevent a malfunction and a failure of the image forming apparatus 101 accompanying a decrease in output caused by an excessive increase in the temperature of the power source circuit board 414. Therefore, the image forming apparatus 101 superior in terms of high production, high stability, and long life can be provided.

The fixing airflow 404 of the fixing conveyance unit 103 includes fixing exhaust heat fans 417*a* to 417*c*, a fixing pressing intake fan 418, a fixing pressing exhaust fan 419, and a moisture exhaust fan 420.

The fixing exhaust heat fan 417 discharges mainly heat released from an upper part on the heating side of the fixing unit 301 to the outside of the image forming apparatus 101. When a component of the fixing unit 301 or a release agent (wax) included in the toner is heated, VOC, dust, and UFP can be released together with the heat. Therefore, a fixing upper exhaust filter 421 for collecting VOC, dust, and UFP is disposed on the downstream side of an air current generated by the fixing exhaust heat fan 417.

The fixing pressing intake fan 418 supplies outside air for cooling to a lower part on the pressing side of the fixing unit 301. The fixing pressing exhaust fan 419 discharges heat released by the lower part on the pressing side of the fixing unit 301 to the outside of the image forming apparatus 101. The moisture exhaust fan 420 discharges water vapor released from the sheet S heated by the fixing unit 301, to the outside of the image forming apparatus 101.

The fixing lower exhaust filter 422 for collecting VOC, dust, and UFP released together with heat and water vapor is disposed on the downstream side of an air current generated by each of the fixing pressing exhaust fan 419, the moisture exhaust fan 420, and the pre-fixing conveyance suction fans 413 described above. In the present exemplary embodiment, each of the fixing pressing exhaust fan 419 and the moisture exhaust fan 420 is an example of a fixing exhaust fan, and is a fan for discharging air present near the fixing unit 301 to the outside of the fixing conveyance unit 103 of the image forming apparatus 101.

According to the above-described configuration of the fixing airflow 404, heat, moisture, VOC, dust, and UFP released in the heating process can be efficiently discharged without being held inside the image forming apparatus 101. In other words, it is possible to prevent an image defect and a malfunction caused by an excessive increase in the temperature of toner or a component of each unit attributable to heat remaining in the image forming apparatus 101.

In addition, it is possible to prevent a fixed-image defect caused by an excessive quantity of heat applied to toner in the fixing process, and poor sheet conveyance such as a fixing separation failure, which are attributable to an excessive increase in temperature on the pressing side of the fixing unit 301. It is also possible to prevent dew condensation of a conveyance guide caused by the attachment of water vapor, and poor conveyance as well as an image defect caused by the attachment of a drop of condensed water to the sheet S. Further, a malfunction and poor sheet conveyance caused by the attachment of a release agent (wax) vaporized by heating and solidified again to a component or the like can be prevented. Therefore, the image forming apparatus 101 superior in terms of high image quality, high stability, and long life can be provided. Moreover, the image forming apparatus 101 superior in terms of environmental friendliness by reducing the amount of discharge of VOC, dust, and UFP to the outside of the image forming apparatus 101 can be provided.

The cooling unit airflow 405 of the fixing conveyance unit 103 is provided with a cooling unit exhaust fan 423 for discharging heat released by the heat sink 303 disposed inside the cooling unit 302, to the outside of the image forming apparatus 101. The heat sink 303 of the cooling unit 302 is a heat exchanger that absorbs heat from the sheet S after fixing via the conveyance belt 302*a* and releases the absorbed heat. According to this configuration, the sheet S heated by the fixing unit 301 can be efficiently cooled, and the quantity of heat released from the sheet S on the downstream conveyance path can be reduced.

In other words, it is possible to prevent an image defect and a malfunction caused by an excessive increase in the temperature of the toner of the image forming unit 102 attributable to the heat released from the sheet S in the two-sided image formation. It is also possible to prevent adhesion of the toner image between the sheets S when a large amount of products are loaded in a post-processing apparatus. Therefore, the image forming apparatus 101 superior in terms of high image quality and high stability can be provided.

The power source (direct current (DC)) airflow 406 of the fixing conveyance unit 103 includes power source exhaust fans 425 and 426 for discharging heat released by a power source circuit board 424 in a DC power source unit 500 to the outside. Accompanying the exhaust by the power source exhaust fans 425 and 426, air for cooling is supplied from a power source intake port 427, so that the power source circuit board 424 can be efficiently cooled. This configuration can prevent a malfunction and a failure accompanying a decrease in output attributable to an excessive increase in the temperature of the power source circuit board 424. Therefore, the image forming apparatus 101 superior in terms of high production and high stability can be provided. A detailed configuration forming the power source airflow 406 will be described below.

The electric component airflow 407 of the fixing conveyance unit 103 is provided with an electric component exhaust fan 430 for discharging heat released by an alternate-current (AC) system power source unit 428 and a conveyance control circuit board 429 to the outside. Accompanying the exhaust by the electric component exhaust fan 430, air for cooling is supplied from electric component intake ports 431 provided in an outer cover on the rear face side of the fixing conveyance unit 103, so that the AC system power source unit 428 and the conveyance control circuit board 429 can be efficiently cooled.

Here, in the AC system power source unit 428 and the conveyance control circuit board 429, the amount of generated heat is smaller than in the DC power source unit 500, and thus the number of fans for forming an airflow is also small. In this configuration, the electric component exhaust fan 430 is disposed above the conveyance control circuit board 429 in the vertical direction. Therefore, the heat emitted from the AC system power source unit 428 and the conveyance control circuit board 429 can be discharged together with air, without remaining around the conveyance control circuit board 429.

The positions and the number of the electric component intake ports 431 in the present exemplary embodiment are not particularly limited. However, the intake position and the exhaust position are diagonally arranged from the lower part to the upper part in the vertical direction on the rear face side of the fixing conveyance unit 103, so that heat generated not only from the AC system power source unit 428 and the conveyance control circuit board 429 but also from various elements can be efficiently discharged using a minimum number of fans.

This configuration can prevent a malfunction and a failure accompanying a decrease in output caused by an excessive increase in the temperature of the AC system power source unit 428 and the conveyance control circuit board 429. Therefore, the image forming apparatus 101 superior in terms of high production and high stability can be provided.

(Image Forming Apparatus: Airflow Balance)

Figure 5A:
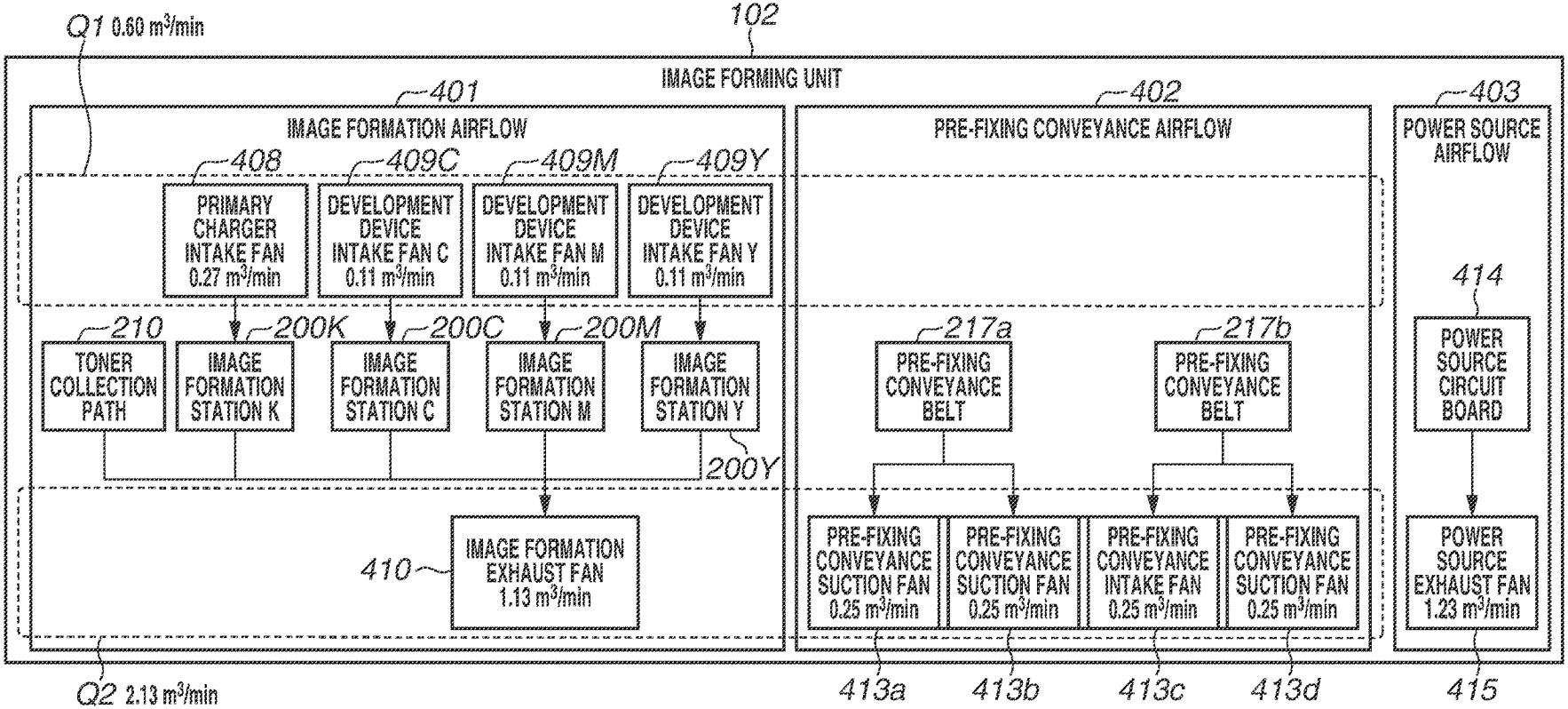
FIGS. 5A and 5B are block diagrams illustrating a fan air quantity of the image forming apparatus.
Figure 5B:
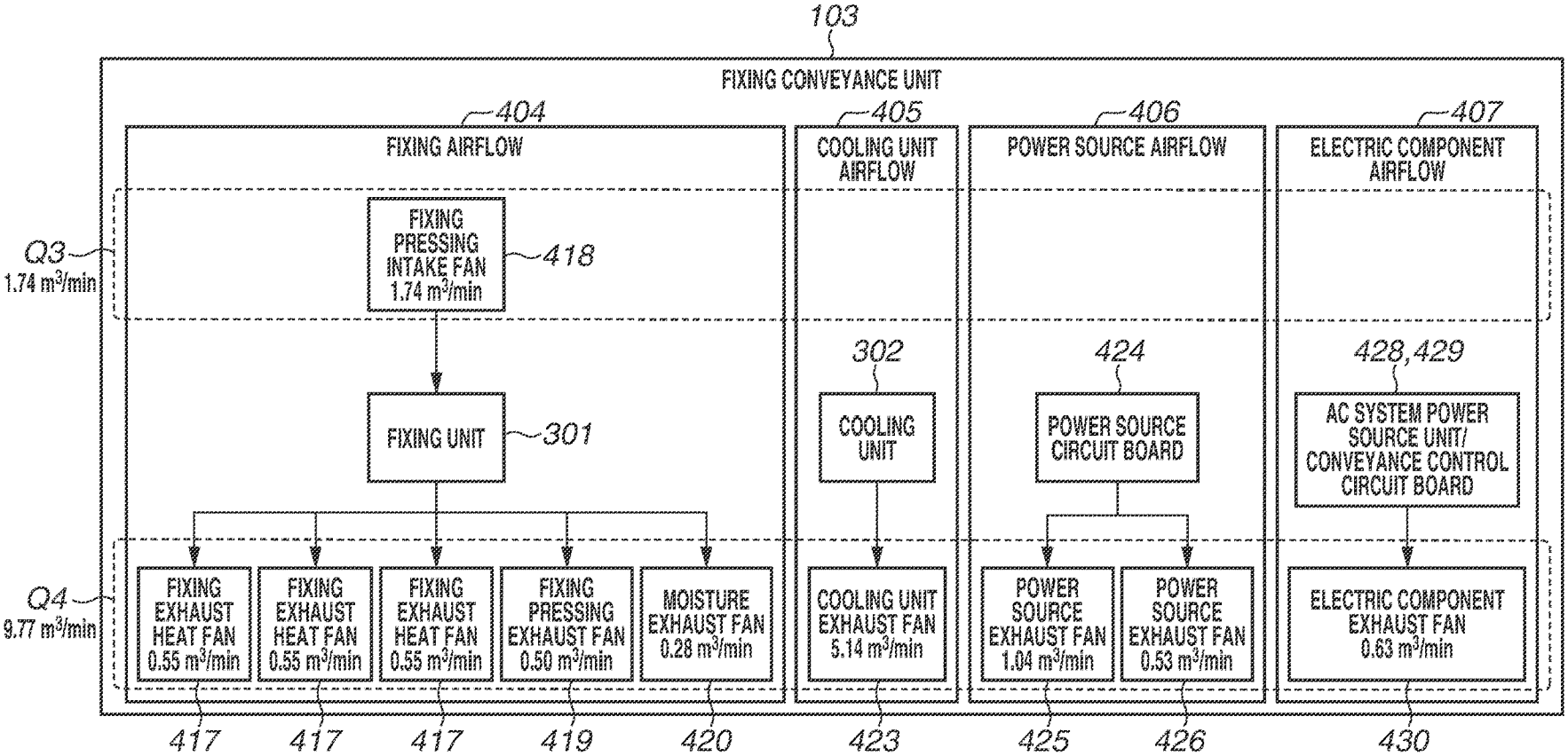

FIGS. 5A and 5B are block diagrams illustrating the air quantities of the intake fans and the exhaust fans of the image forming apparatus 101 of the present exemplary embodiment. FIG. 5A illustrates the air quantity of each of the fans of the image forming unit 102, and FIG. 5B illustrates the air quantity of each of the fans of the fixing conveyance unit 103. Each of numerical values illustrated in FIGS. 5A and 5B indicates the air quantity of each of the fans in image formation for thick paper, as an example.

A broken line in FIG. 5A indicates the summing range of each of an air quantity sum Q1 of the intake fan and an air quantity sum Q2 of the exhaust fan affecting the inside of the image forming unit 102 of the image forming apparatus 101. Here, the power source airflow 403 is formed by an independent air path not connected to the inside of the image forming unit 102 and the fixing conveyance unit 103, and is configured to perform direct intake and discharge with respect to the outside air. Therefore, the power source airflow 403 does not affect the airflow inside the image forming unit 102 and thus is excluded from the total value. Here, the intake fan is a fan for taking air from the outside into the inside of the image forming apparatus 101, and each of the primary charger intake fan 408 and the three development device intake fans 409C, 409M, and 409Y among the fans in the image forming unit 102 corresponds to the intake fan. The exhaust fan is a fan for discharging air from the inside to the outside of the image forming apparatus 101, and each of the image formation exhaust fan 410 and the four pre-fixing conveyance suction fans 413*a* to 413*d* among the fans in the image forming unit 102 corresponds to the exhaust fan.

In the present exemplary embodiment, the air quantity sum Q2 of the exhaust fan is greater than the air quantity sum Q1 of the intake fan in the image forming unit 102 of the image forming apparatus 101, as follows.

Q1: 0.60 $m^3$/min<Q2: 2.13 $m^3$/min

According to this configuration, the inside of the image forming unit 102 can be kept at a relatively low negative pressure as compared with the outside air. Therefore, it is possible to prevent ozone and dust inside the image forming unit 102 from leaking to the outside of the image forming apparatus 101 through a minute space in a portion such as a joint of the outer cover. In other words, in the image formation exhaust filter 412 disposed at the airflow exhaust port of the image forming unit 102, ozone and dust inside the image forming apparatus 101 are reliably collected, so that the image forming apparatus 101 superior in terms of environmental friendliness can be provided.

A broken line in FIG. 5B indicates the summing range of each of an air quantity sum Q3 of the intake fan and an air quantity sum Q4 of the exhaust fan affecting the inside of the fixing conveyance unit 103 of the image forming apparatus 101. Here, the intake fan is a fan for taking air from the outside into the inside of the image forming apparatus 101, and the fixing pressing intake fan 418 among the fans in the fixing conveyance unit 103 corresponds to the intake fan.

The exhaust fan is a fan for discharging air from the inside to the outside of the image forming apparatus 101. Each of the three fixing exhaust heat fans 417, the fixing pressing exhaust fan 419, the moisture exhaust fan 420, the cooling unit exhaust fan 423, the power source exhaust fans 425 and 426, and the electric component exhaust fan 430, among the fans in the fixing conveyance unit 103, corresponds to the exhaust fan.

In the present exemplary embodiment, the air quantity sum Q4 of the exhaust fan is greater than the air quantity sum Q3 of the intake fan.

Q3: 1.74 $m^3$/min<Q4: 9.77 $m^3$/min

According to this configuration, the inside of the fixing conveyance unit 103 can be kept at a relatively low negative pressure as compared with the outside air. Therefore, it is possible to prevent VOC, dust, and UFP inside the fixing conveyance unit 103 from leaking to the outside of the image forming apparatus 101 through a minute space in a portion such as a joint of the outer cover. In other words, in the fixing upper exhaust filter 421 and the fixing lower exhaust filter 422 disposed at the airflow exhaust ports of the fixing conveyance unit 103, VOC, dust, and UFP inside the image forming apparatus 101 are reliably collected, so that the image forming apparatus 101 superior in terms of environmental friendliness can be provided.

Furthermore, in the present exemplary embodiment, the air quantity of the difference between the air quantity sum Q4 of the exhaust fan and the air quantity sum Q3 of the intake fan in the fixing conveyance unit 103 is greater than the air quantity of the difference between the air quantity sum Q2 of the exhaust fan and the air quantity sum Q1 of the intake fan in the image forming unit 102.

(Q2-Q1): 1.53 $m^3$/min<(Q4-Q3): 8.03 $m^3$/min

According to this configuration, the inside of the fixing conveyance unit 103 can be kept at a relatively low negative pressure as compared with the inside of the image forming unit 102. Therefore, heat, VOC, dust, UFP, and water vapor released inside the fixing conveyance unit 103 can be prevented from flowing into the image forming unit 102 through a connection portion connecting the image forming unit 102 and the fixing conveyance unit 103. In other words, it is possible to prevent heat, VOC, dust, UFP, and water vapor easily generated near the fixing unit 301 from flowing into the housing of the image forming unit 102 disposed next to the fixing conveyance unit 103.

Therefore, it is possible to prevent troubles such as an image defect and a malfunction caused by a deterioration in fluidity of toner attributable to a flow of heat of the fixing unit 301 into the image forming unit 102, an image defect, poor conveyance, and a malfunction caused by the attachment of inflowing VOC, dust, or UFP to a component, and an image defect and poor conveyance caused by dew condensation of a component attributable to an inflow of water vapor.

Based upon the foregoing, heat released inside the fixing conveyance unit 103 is efficiently discharged from the airflow exhaust ports of the fixing conveyance unit 103 without being held inside the image forming unit 102, and VOC, dust, and UFP are reliably collected by the fixing upper exhaust filter 421 and the fixing lower exhaust filter 422 disposed at the exhaust ports. Therefore, the image forming apparatus 101 superior in terms of high image quality, high stability, and long life and also superior in terms of environmental friendliness can be provided.

(Fixing Conveyance Unit: Power Source Airflow 406)

Next, each configuration of the power source airflow 406 of the present exemplary embodiment will be described with reference to FIG. 6. As described above, the power source airflow 406 is an airflow for discharging heat released by the power source circuit board 424 to the outside, and is an airflow passing through the DC power source unit 500 containing the power source circuit board 424.

Figure 6:
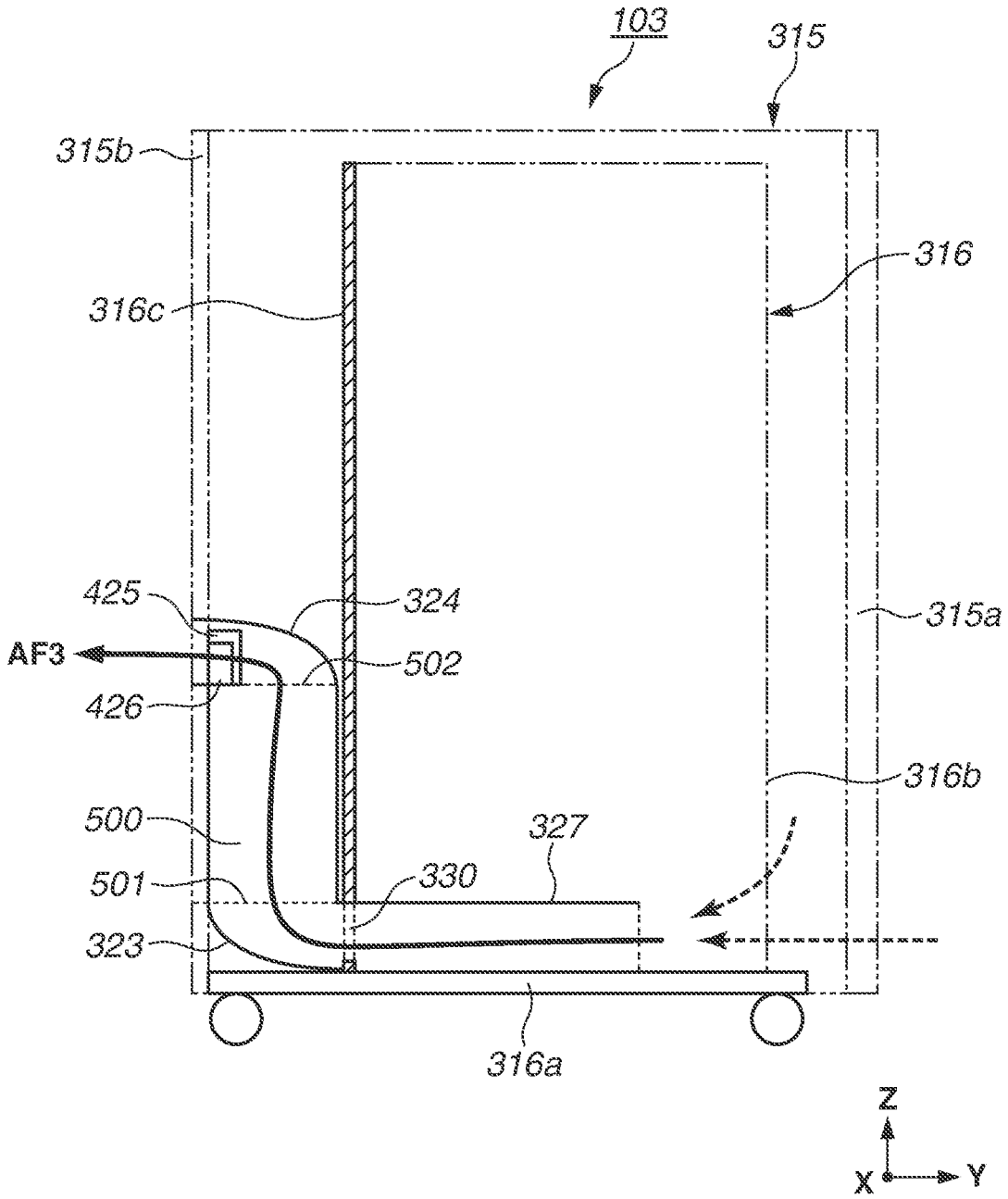
FIG. 6 is a schematic cross-sectional view illustrating a direct-current (DC) power source airflow in the fixing conveyance unit of the image forming apparatus.

FIG. 6 is a schematic cross-sectional view of the fixing conveyance unit 103, at a portion near the DC power source unit 500.

The fixing conveyance unit 103 has a support frame 316 that supports the fixing unit 301, the cooling unit 302, the sheet discharge conveyance path 304, and the like, and an outer cover 315 that covers the support frame 316 and forms an external surface of the fixing conveyance unit 103. Here, in the image forming apparatus 101 (the fixing conveyance unit 103), the arrow-X direction indicates the sheet conveyance direction, an arrow-Z direction indicates the vertical direction, and an arrow-Y direction indicates the front-back direction. In the present exemplary embodiment, the front-back direction is an example of a direction orthogonal to the sheet conveyance direction and the vertical direction.

The outer cover 315 has a front cover 315*a* on the front side (the front face side) in the front-back direction (the arrow-Y direction) of the fixing conveyance unit 103 of the image forming apparatus 101, and a rear cover 315*b* on the rear face side in the front-back direction. The front cover 315*a* can be opened and closed with respect to other outer covers and the support frame 316, and conveyance units such as the fixing unit 301 and the cooling unit 302 can be accessed by bringing the front cover 315*a* into the open state. A user and a serviceman can access each unit from the front face side of the fixing conveyance unit 103 by opening the front cover 315*a* in a case where a conveyance failure has occurred, during maintenance, or the like. During the maintenance, each of the fixing unit 301 and the cooling unit 302 can be removed from and inserted into the support frame 316 as a whole by opening the front cover 315*a*.

The support frame 316 has a bottom plate 316*a* to which an installation unit such as a caster is attached, a support portion 316*b* on the front side (the front face side) in the front-back direction (the arrow-Y direction) of the fixing conveyance unit 103 of the image forming apparatus 101, and a rear plate 316*c* on the rear side (the rear face side) in the front-back direction. The bottom plate 316*a*, the support portion 316*b*, and the rear plate 316*c* are each configured using sheet metal, and connected to each other by screw, welding, or the like. The outer cover 315 covers the support frame 316 except for the bottom surface. In the present exemplary embodiment, the side (the front face side) more frontward than the center of the fixing conveyance unit 103 of the image forming apparatus 101 in the front-back direction is one end side of the fixing conveyance unit 103, and the side (the rear face side) more rearward than the center of the fixing conveyance unit 103 is the other end side of the fixing conveyance unit 103.

Therefore, the rear plate 316*c* of the support frame 316 may not be necessarily connected to an end of the bottom plate 316*a*.

The DC power source unit 500 has a box shape and is provided with an intake port 501 located at a lower end portion in the vertical direction and an exhaust port 502 located at an upper end portion in the vertical direction. The DC power source unit 500 holds a plurality of electric circuit boards such as the power source circuit board 424 in the inside thereof.

An intake duct 323 is connected to a lower part of the DC power source unit 500 in the vertical direction. The intake duct 323 is connected to an introduction duct 327 extending in the front-back direction (the arrow-Y direction). The introduction duct 327 is a duct having an intake port on the side more frontward than a central part of the fixing conveyance unit 103 in the front-back direction, and is fixed to the bottom plate 316*a*.

Further, disposed above the DC power source unit 500 in the vertical direction are the two power source exhaust fans 425 and 426 for forming an airflow for discharging air present inside the DC power source unit 500, and an exhaust duct 324 for guiding the airflow formed by the power source exhaust fans 425 and 426 to the outside of the fixing conveyance unit 103. The power source exhaust fans 425 and 426 are disposed inside the exhaust duct 324, and form the power source airflow 406 for passing air taken in via an opening of the introduction duct 327, through the intake duct 323, the DC power source unit 500, and the exhaust duct 324. The power source exhaust fans 425 and 426 then discharge the air present inside the DC power source unit 500 to the outside of the fixing conveyance unit 103 of the image forming apparatus 101, via an opening (not illustrated) formed in the rear cover 315*b*.

Heat released by the plurality of circuit boards including the power source circuit board 424 disposed inside the DC power source unit 500 is thereby discharged to the outside of the fixing conveyance unit 103 of the image forming apparatus 101, so that an increase in the temperature of the circuit boards can be suppressed.

The intake port of the introduction duct 327 is located on the side more frontward than the rear plate 316*c* of the support frame 316, and on the side more rearward than the support portion 316*b*, in the front-back direction. Therefore, the introduction duct 327 is configured to take in the outside air from positions near the front face of the fixing conveyance unit 103, such as an intake port (not illustrated) provided in the front cover 315*a* or on the front side of the left side surface, and a space between components of the exterior. Here, an airflow indicated an arrow AF3 illustrated in FIG. 6 (hereinafter referred to as the airflow AF3) is an example of the power source airflow 406, and indicates the airflow caused by the power source exhaust fans 425 and 426. As indicated by the airflow AF3, the introduction duct 327 is an example of a duct unit that forms an air path for sending the air taken in from the intake port to the inside of the DC power source unit 500.

In the above-described configuration, the intake position and the exhaust position are as far away from each other as possible in the front-back direction of the fixing conveyance unit 103, with respect to the DC power source unit 500 including the electric circuit boards in which the amount of heat generation is relatively large, so that the air discharged from the DC power source unit 500 is prevented from being directly taken in from the intake port of the DC power source unit 500. The room-temperature fresh outside air affected as little as possible by the exhaust heat of the DC power source unit 500 can be thereby taken in, so that a highly efficient cooling effect can be obtained.

Further, the intake port 501 and the exhaust port 502 are provided in the lower surface and the upper surface, respectively, of the DC power source unit 500 in the vertical direction, so that an airflow is formed by a flow of air caused by natural convection even if the power source exhaust fans 425 and 426 are temporarily stopped. Therefore, a configuration in which heat is less likely to remain inside the DC power source unit 500 is provided.

(Fixing Conveyance Unit: Fixing Airflow 404)

Figure 7:
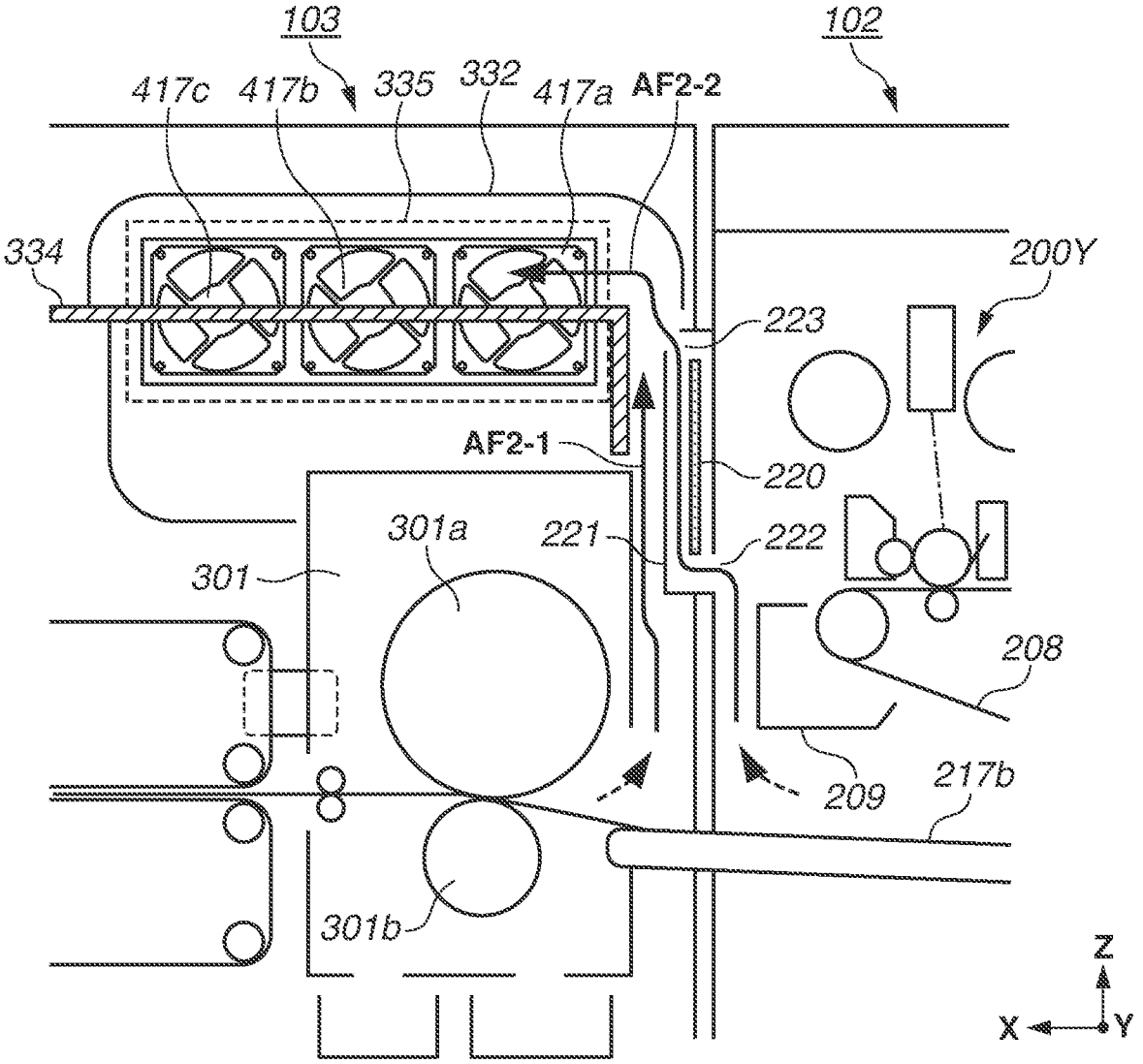
FIG. 7 is a schematic cross-sectional view of a part of a connection portion connecting the image forming unit and the fixing conveyance unit of the image forming apparatus.
Figure 8:
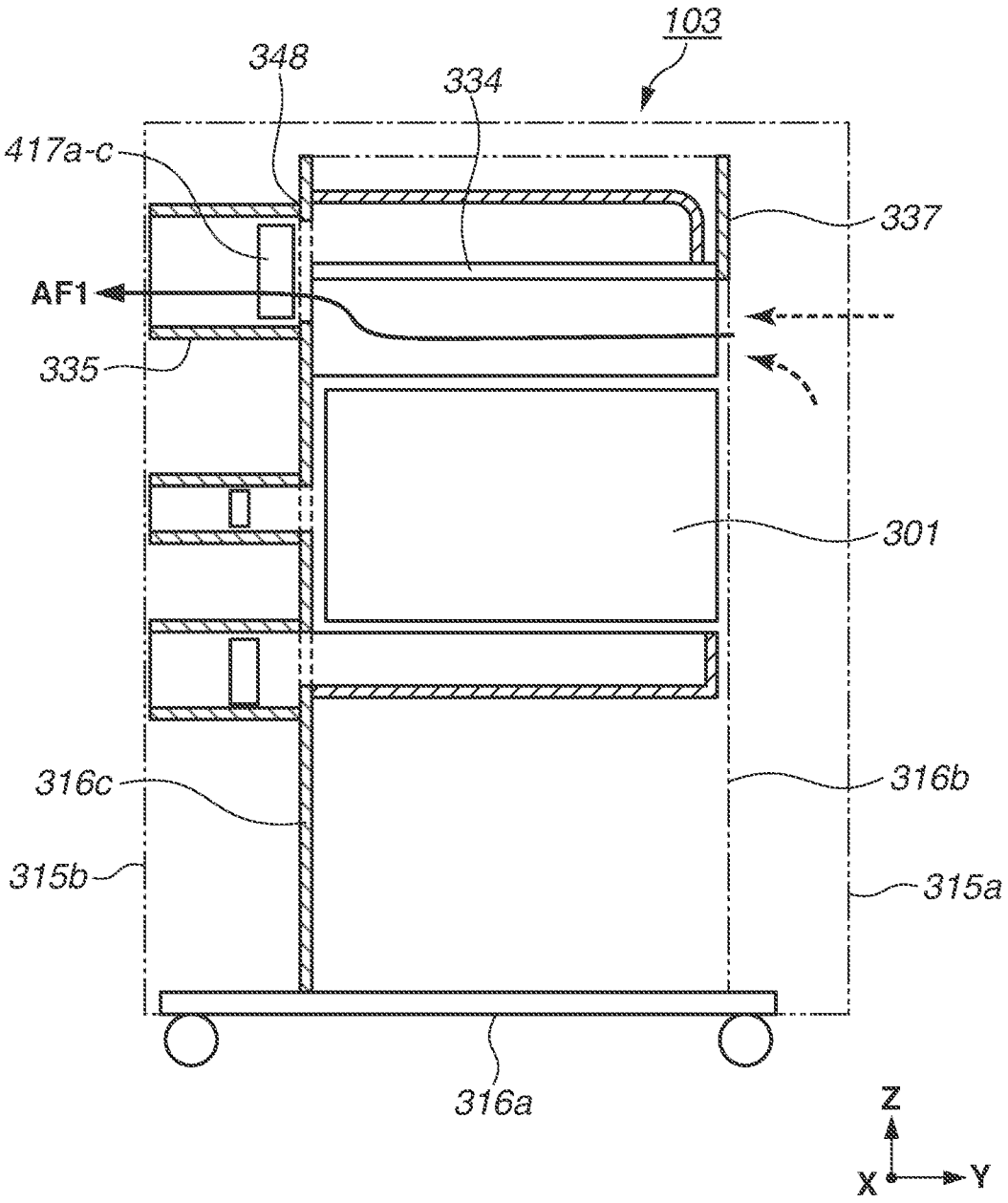
FIG. 8 is a schematic cross-sectional view illustrating an airflow of a fixing unit when the fixing conveyance unit of the image forming apparatus is viewed from the left side-surface side.
Figure 9:
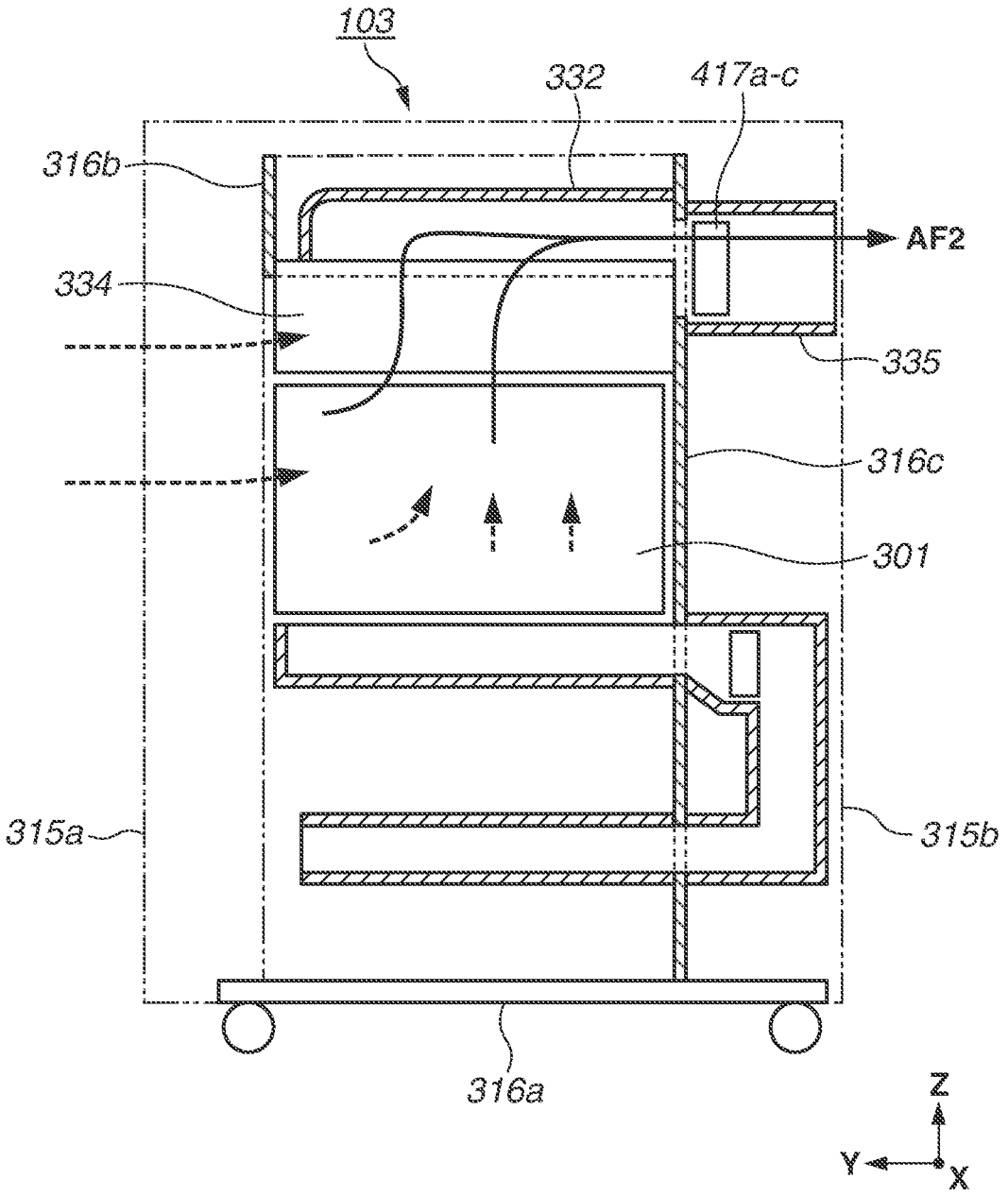
FIG. 9 is a schematic cross-sectional view illustrating an airflow of the fixing unit when the fixing conveyance unit of the image forming apparatus is viewed from the right side-surface side.

Next, an airflow related to cooling and heat exhaust near the fixing unit 301 and a primary transfer high pressure circuit board 220 disposed on the left side-surface side of the image forming unit 102 will be described with reference to FIGS. 7, 8, 9, and 10. FIG. 7 is a schematic cross-sectional view illustrating the fixing unit 301 and the neighborhood thereof. FIG. 8 is a schematic cross-sectional view illustrating an upper airflow of the fixing unit 301, when the fixing conveyance unit 103 is viewed from the left side. FIG. 9 is a schematic cross-sectional view illustrating an upper airflow of the fixing unit 301, when the fixing conveyance unit 103 is viewed from the right side.

In the present exemplary embodiment, the rear plate 316*c* of the fixing conveyance unit 103 is provided with a heat exhaust port 348 near the fixing unit 301. An exhaust heat duct 335 is disposed to connect the rear plate 316*c* and a heat exhaust port (not illustrated) of the rear cover 315*b*, and the three fixing exhaust heat fans 417*a* to 417*c* are disposed inside the exhaust heat duct 335.

Further, above the fixing unit 301 in the vertical direction, a top plate 334 having an L-shape when viewed from the front face is disposed between the rear plate 316*c* and the support portion 316*b* of the fixing conveyance unit 103 in the front-back direction. The top plate 334 divides a flow of air formed by the fixing exhaust heat fans 417*a* to 417*c* into two layers on the inner side and the outer side of the L-shape (in the up-down direction and the left-right direction).

As illustrated in FIG. 7 and FIG. 8, the top plate 334 is intended to set an airflow (indicated by an arrow AF1 in FIG. 8, hereinafter referred to as the airflow AF1) directly above the fixing unit 301, and an airflow (indicated by an arrow AF2 in FIG. 9, hereinafter referred to as the airflow AF2) for discharging air to the outside of the apparatus. In the airflow AF1, outside air is taken in from an intake port (not illustrated) of the exterior of the front face including the front cover 315*a*, and a space between the members of the exterior, and the air is discharged from the rear face to the outside of the apparatus upon passing through a space substantially surrounded by the upper surface of the fixing unit 301 and the top plate 334. In the airflow AF2, as illustrated in FIG. 7, air mainly from a space of the connection portion between the image forming unit 102 and the fixing conveyance unit 103 and from the inside of each of these units is lifted up to the upper surface of the top plate 334 in the vertical direction, through a space surrounded by the fixing unit 301, the top plate 334, and the left side surface of the image forming unit 102, and the lifted air is discharged from the rear face to the outside of the apparatus upon passing through a space surrounded by the top plate 334 and the exhaust heat duct 335.

Here, while the main role of the airflow AF1 is to discharge heat generated from the fixing unit 301, the airflow AF2 has mainly the following three roles. The first role is to discharge a part (indicated by a broken line arrow) of cooling air of the pressing roller 301*b* in the fixing unit 301 illustrated in FIG. 7 (hereinafter referred to as the airflow AF2-1). The second role is to discharge heat generated from the primary transfer high pressure circuit board 220 disposed on the left side of the image forming unit 102 (hereinafter referred to as the airflow AF2-2). Specifically, as illustrated in FIG. 7, the airflow AF2-2 is an airflow mainly for passing air inside the image forming unit 102 on the inner side of a left cover 221 protecting the primary transfer high pressure circuit board 220 from an inflow port 222, and merging the air from an outlet 223 provided in an upper part of the left cover 221 with the airflow AF2-1. This prevents heat from staying around the primary transfer high pressure circuit board 220. The third role is to form a so-called air curtain for cutting off heat generated from the fixing unit 301 and the like during operation including the image formation, using the airflows illustrated in FIG. 7 and FIG. 9. The air curtain protects components having toner and disposed inside the image forming unit 102, such as the development device 204, the toner bottle 205, and the transfer belt cleaner 216, and components whose performance is susceptible to heat such as the laser scanner 203, against the heat generated inside the fixing conveyance unit 103.

In the present exemplary embodiment, the three fixing exhaust heat fans 417*a* to 417*c* are arranged side by side in a line, and roughly two flows of the airflows AF1 and AF2 are formed by the top plate 334. However, the number of the fans and the arrangement thereof are not particularly limited, and a similar effect can be obtained if a configuration that can form a similar flow of air is adopted.

Figure 10:
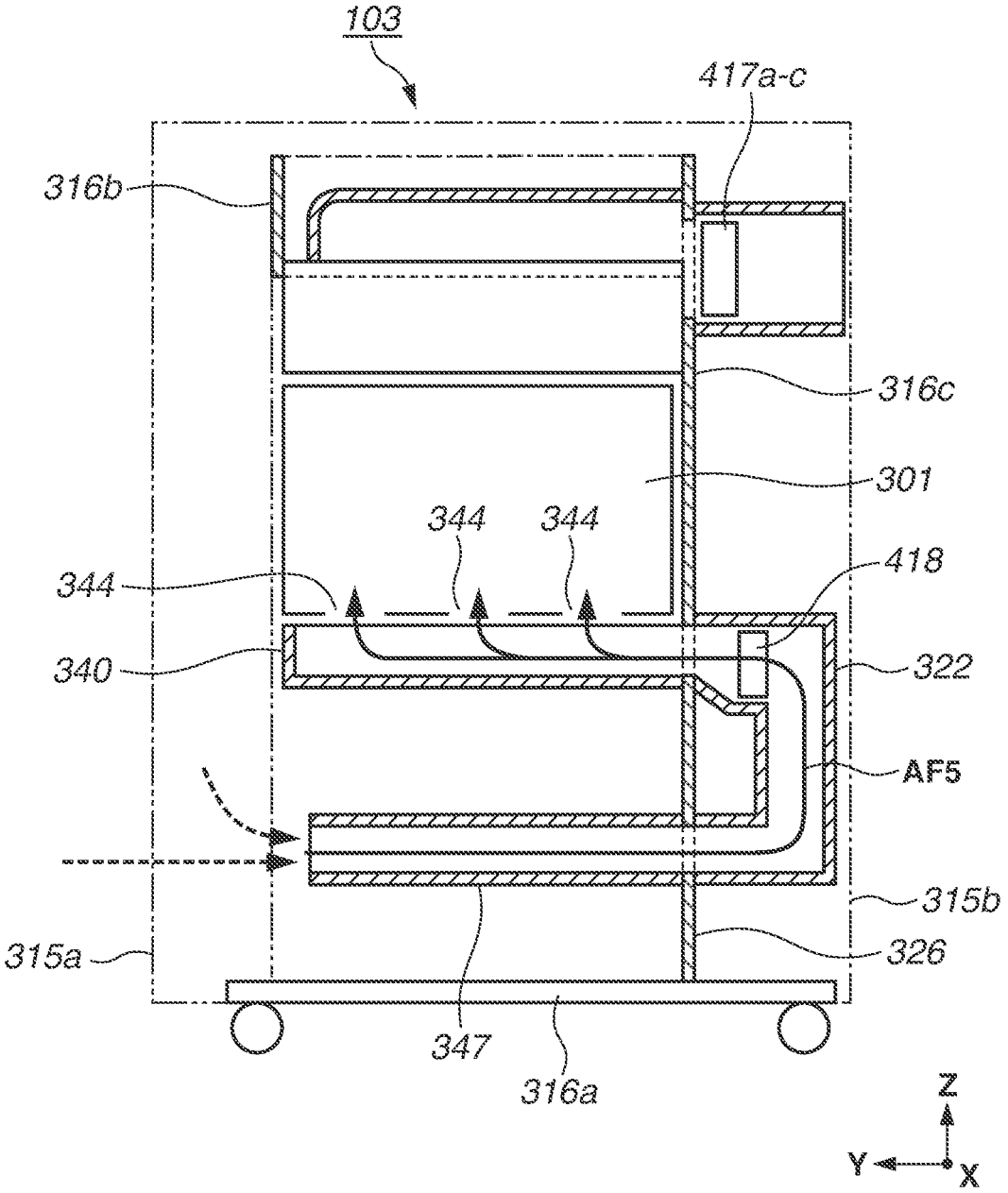
FIG. 10 is a schematic cross-sectional view illustrating an airflow of the fixing unit when the fixing conveyance unit of the image forming apparatus is viewed from the right side-surface side.
Figure 11:
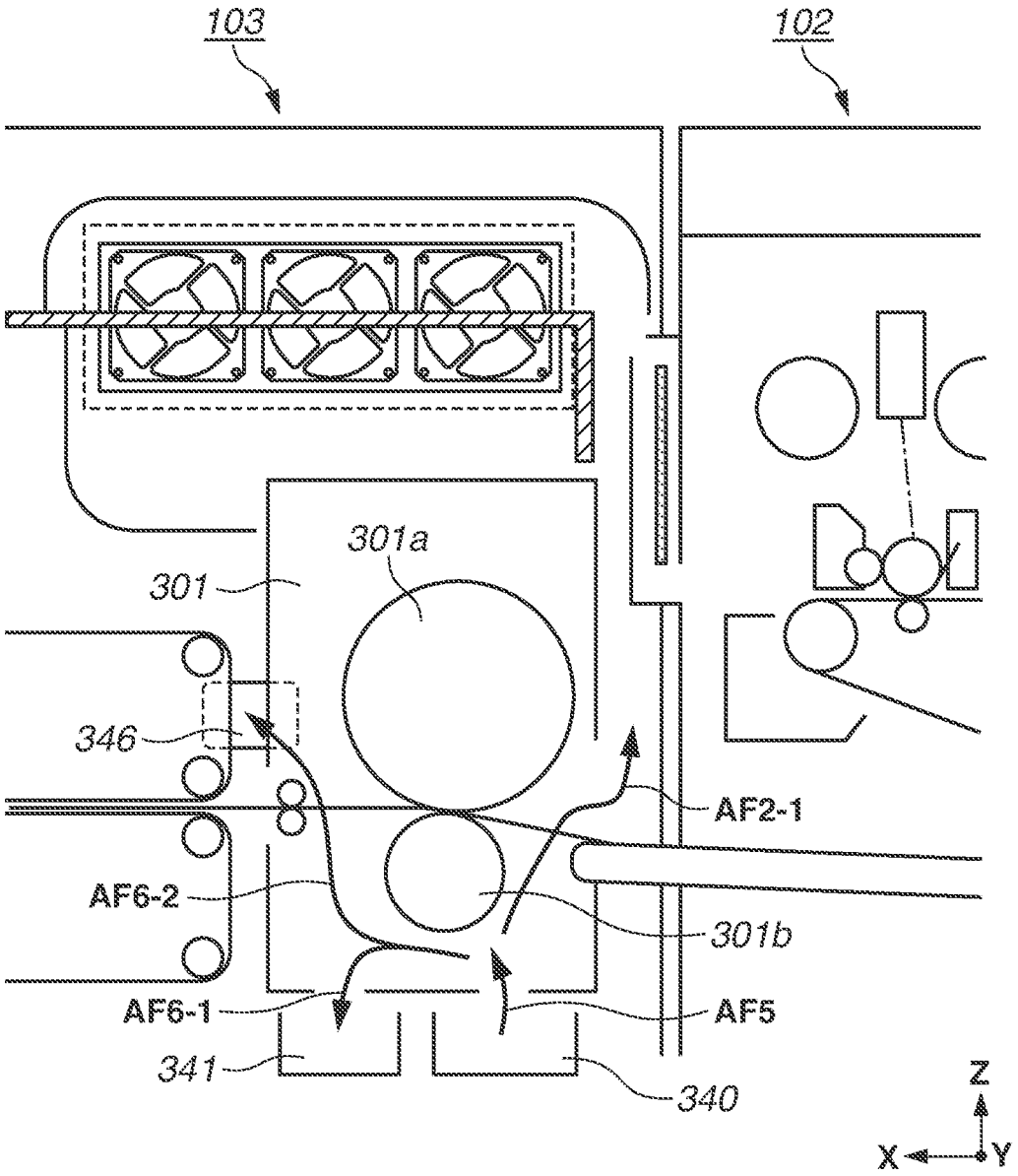
FIG. 11 is a schematic cross-sectional view illustrating an airflow of the fixing conveyance unit of the image forming apparatus.
Figure 12:
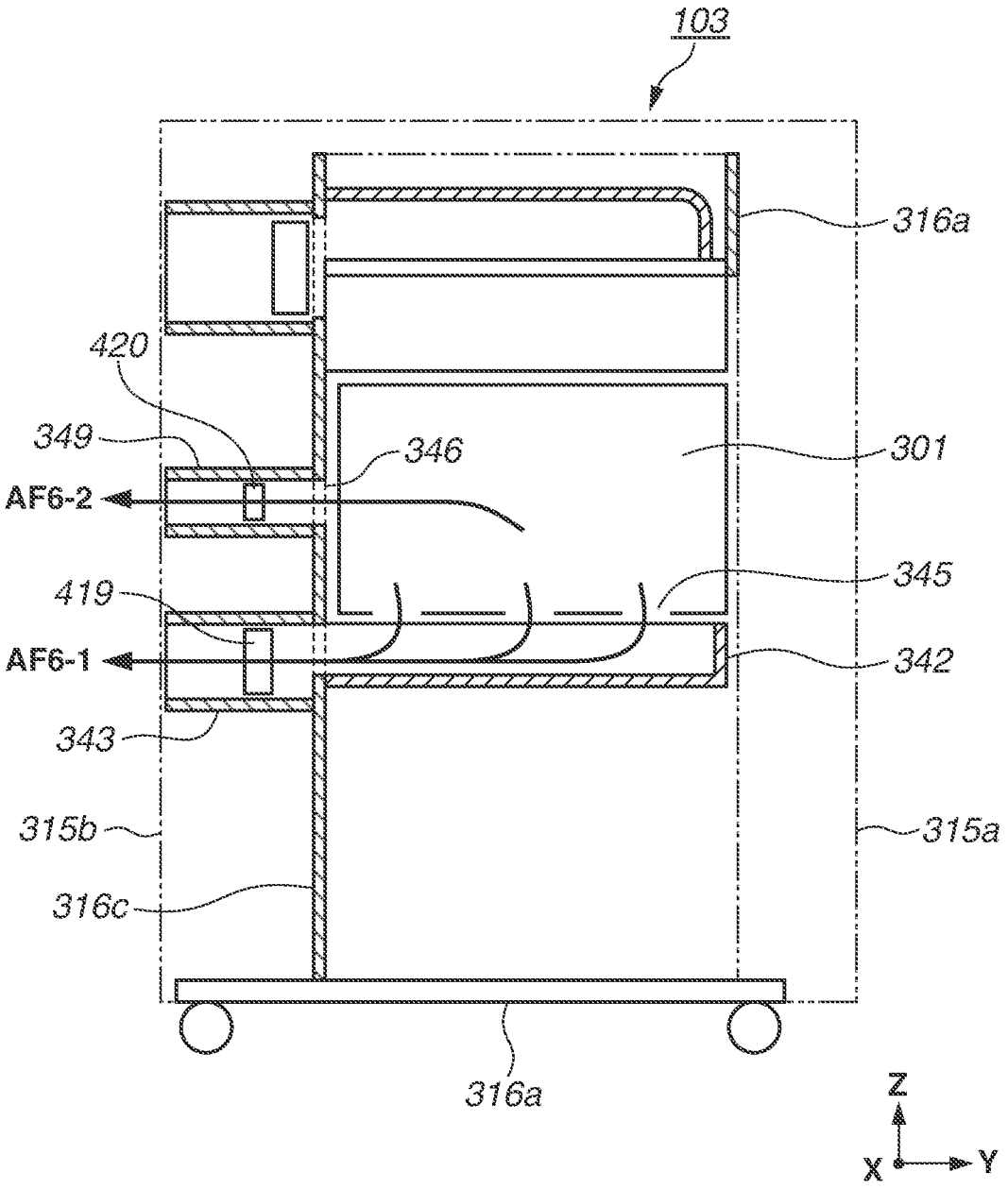
FIG. 12 is a schematic cross-sectional view illustrating an airflow of the fixing unit when the fixing conveyance unit of the image forming apparatus is viewed from the left side-surface side.

Next, an airflow for cooling the pressing roller 301*b* inside the fixing unit 301 will be described with reference to FIG. 10 to FIG. 12. FIG. 10 is a schematic cross-sectional view illustrating a pressing roller airflow of the fixing unit 301, when the fixing conveyance unit 103 is viewed from the right side. FIG. 11 is a schematic cross-sectional view of the fixing unit 301 and the neighborhood thereof. FIG. 12 is a schematic cross-sectional view illustrating the pressing roller airflow of the fixing unit 301, when the fixing conveyance unit 103 is viewed from the left side.

The fixing pressing intake fan 418 is included in a U-turn duct 322 disposed on the rear face side of the rear plate 316*c* of the fixing conveyance unit 103. By rotating the fixing pressing intake fan 418, air for cooling the pressing roller 301*b* passes through a cooling air intake duct 340 disposed below the fixing unit 301, and is sent from one or a plurality of cooling air intake ports 344 provided in the bottom surface of the fixing unit 301 into the fixing unit 301. The pressing roller 301*b* is cooled as appropriate by blowing the air against the pressing roller 301*b* as the cooling air.

A cooling air intake duct 347 is disposed inside the frame of the fixing conveyance unit 103 and connected to the U-turn duct 322 via the rear plate 316*c* to take in the air, so that an intake route to the fixing pressing intake fan 418 is formed. The outside air least affected by the own exhaust heat is thereby taken in from an intake port (not illustrated) of the exterior of the front face including the front cover 315*a*, and a space between the members of the exterior of the front face. An airflow AF5 of the fixing pressing intake fan 418 is illustrated in FIG. 10.

Subsequently, in an exhaust route, the air increased in temperature by being blown against the pressing roller 301*b* is divided into mainly three routes as illustrated in FIG. 11. The first route is a route for air leaking to the side upstream from the fixing nip formed by the heating roller 301*a* and the pressing roller 301*b*, in the conveyance direction. This air is discharged to the outside of the apparatus as the above-described airflow AF2-1.

The second route is, as illustrated in FIG. 12, a route for an airflow AF6-1 in which air from one or a plurality of cooling air exhaust ports 345 provided in the bottom surface of the fixing unit 301 passes through a cooling air discharge inner duct 342 disposed below the fixing unit 301, and the air is then discharged from a cooling air discharge outer duct 343 disposed on the rear face side of the rear plate 316*c* of the fixing conveyance unit 103 to the outside of the apparatus via an exhaust port formed in the rear face of the fixing conveyance unit 103. Further, in the present exemplary embodiment, in order to maximize the heat exhaust by the airflow AF6-1, the fixing pressing exhaust fan 419 is disposed inside the cooling air discharge outer duct 343, so that a high ratio of the amount of air discharged by this route is secured.

The third route is a route for an airflow AF6-2 of the air that is a part of the air leaked from the airflow AF6-1, and is leaked to the side downstream from the fixing nip formed by the heating roller 301*a* and the pressing roller 301*b* in the conveyance direction and above this fixing nip. In the airflow AF6-2, as illustrated in FIG. 12, air from a moisture exhaust port 346 provided in the rear plate 316*c* passes through a moisture exhaust duct 349, and is then discharged from the rear face of the fixing conveyance unit 103 to the outside of the apparatus. Further, in the airflow AF6-2, water vapor generated from the sheet S passing through the fixing nip is mixed with the air and thus the humidity is high. Therefore, if a flow of air stays in this area, a drop of water is attached to a member such as a guide member of the conveyance system at the time of, in particular, the image formation immediately after the power-on. This drop of water wets the image surface of the sheet S after the completion of the image formation, and thereby causes an image defect such as density unevenness in the worst case. For this reason, it may be desirable to discharge the air regularly and reliably, and therefore, in the present exemplary embodiment, the moisture exhaust fan 420 is included in the moisture exhaust duct 349.

In the present exemplary embodiment, because the fixing unit 301 is disposed on the frontward side for maintenance and jam clearing, and in order to secure a space on the front face side for jam clearing in the two-sided printing conveyance path 307 located below the fixing unit 301, the fixing pressing intake fan 418 is disposed on the rear face side of the fixing conveyance unit 103. However, in a case where these restrictions are not necessary, a similar effect can be obtained in terms of cooling of the pressing roller 301*b* even if the fixing pressing intake fan 418 is disposed on the front face side, and therefore, the position of the fixing pressing intake fan 418 is not particularly limited.

(Fixing Conveyance Unit: Cooling Unit Airflow 405)

Figure 13:
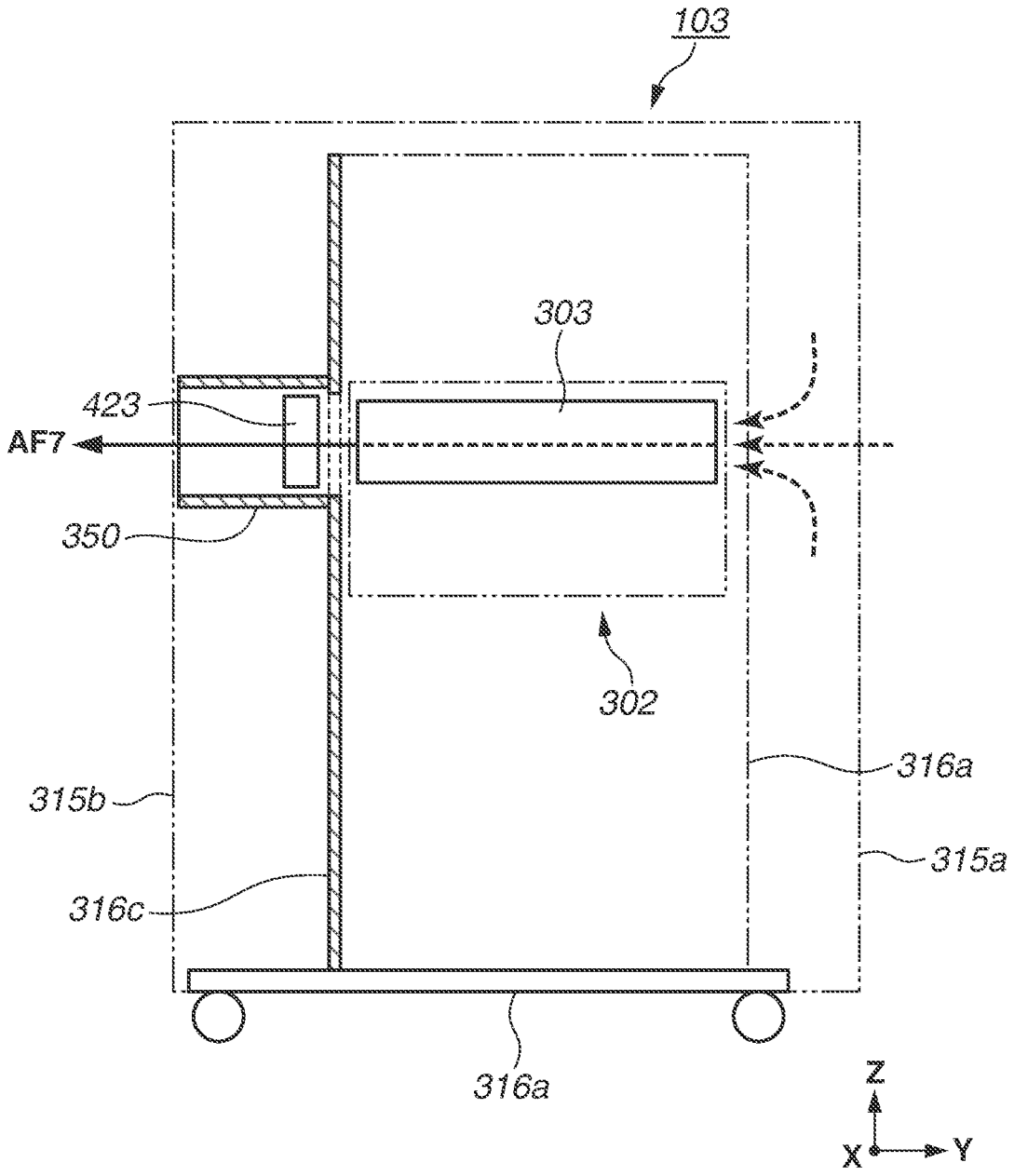
FIG. 13 is a schematic cross-sectional view illustrating an airflow of a cooling device when the fixing conveyance unit of the image forming apparatus is viewed from the left side-surface side.

Next, the cooling unit airflow 405 of the cooling unit 302 will be described with reference to FIG. 13. FIG. 13 is a schematic cross-sectional view illustrating an upper airflow of the cooling unit 302, when the fixing conveyance unit 103 is viewed from the left side. In the present exemplary embodiment, the cooling unit airflow 405 is indicated by an arrow AF7 in FIG. 13.

The cooling unit exhaust fan 423 is disposed inside a cooling device exhaust duct 350 located on the rear face side of the rear plate 316*c* of the fixing conveyance unit 103. As illustrated in FIG. 13, in the cooling unit exhaust fan 423, for the heat sink 303 disposed at the inner circumferential surface of the conveyance belt of the cooling unit 302, the outside air is taken in from the front face of the fixing conveyance unit 103, and discharged from the rear face of the fixing conveyance unit 103. Here, even if the cooling unit exhaust fan 423 is fixed to the cooling unit 302, a similar effect can be obtained and thus how the cooling unit exhaust fan 423 is disposed is not particularly limited.

In this way, concerning the fixing conveyance unit 103 having many units that generate a large amount of heat as compared with the image forming unit 102, the above-described basic configuration of airflow is provided, so that the outside air is taken in from the front face of the fixing conveyance unit 103 or the neighborhood thereof and is all discharged from the rear face, and thus an influence of its own exhaust heat can be avoided as much as possible. In addition, an appropriate state can be maintained independently of an installation environment in which, for example, similarly-formed or identical image forming apparatuses are disposed back-to-back, or an apparatus having a heat source is disposed on the rear face of the present system. Moreover, it is possible to prevent a user or a serviceman from feeling unpleasant when an exhaust port for an airflow is disposed at the front of a printer.

As described above, in the present exemplary embodiment, in the fixing conveyance unit 103 provided with the plurality of exhaust ports on the rear face side of the image forming apparatus 101, the air in the airflow related to the units generating a large amount of heat is taken in from the front face side of the fixing conveyance unit 103 and then discharged from the rear face side of the fixing conveyance unit 103, so that the cooling efficiency of each of the units can be increased.

Further, in the airflow AF3 of the DC power source unit 500 (an electric component) of the present exemplary embodiment, the direct intake of the air discharged from the exhaust ports in other airflows is suppressed, so that the circuit board inside the DC power source unit 500 (the electric component) can be efficiently cooled. This configuration can prevent a malfunction and a failure accompanying a decrease in output attributable to an excessive increase in the temperature of the power source circuit board 424. Therefore, the image forming apparatus 101 superior in terms of high production and high stability can be provided.

An electric component unit having a circuit board and disposed on the rear side of an image forming apparatus can be efficiently cooled using the present exemplary embodiment.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-207102, filed Dec. 14, 2020, which is hereby incorporated by reference herein in its entirety.

What is claimed is:

1. An image forming apparatus to form an image on a sheet, the image forming apparatus comprising:

a supporting frame configured to support a sheet conveying unit configured to convey the sheet, including a rear sheet metal disposed more rearward than the sheet conveying unit in a front-back direction of the image forming apparatus, and having an opening;

a rear cover included in an exterior cover, disposed more rearward than the rear sheet metal in the front-back direction, configured to cover at least a part of the rear sheet metal, and having an exhausting port for exhausting air;

a duct including an intake for taking in air and an outlet for exhausting air inside the duct and provided inside the exterior cover such that (i) the duct connects the intake and the outlet, (ii) the intake is located more frontward than the rear sheet metal in the front-back direction, (iii) the duct passes through the opening, and (iv) the outlet is connected to the exhausting port;

a circuit board configured to drive the sheet conveying unit and disposed inside the duct between the rear sheet metal and the rear cover; and a fan configured to generate an air flow from the intake to the outlet to cool the circuit board inside the duct.

2. The image forming apparatus according to claim 1, wherein the intake is located more frontward than a center of the image forming apparatus in the front-back direction.

3. The image forming apparatus according to claim 1, wherein a position of the exhausting port is higher than that of the circuit board in a vertical direction.

4. The image forming apparatus according to claim 1, wherein the supporting frame includes a bottom plate which supports the rear sheet metal and to which the rear sheet metal is fixed, and wherein the duct is supported by the bottom plate.

5. The image forming apparatus according to claim 1, further comprising:

a first housing having an image formation unit to form a toner image on the sheet; and a second housing having a fixing unit to fix the toner image formed by the image formation unit to the sheet, and disposed next to the first housing, wherein the supporting frame is included in the second housing and supports the fixing unit.

6. The image forming apparatus according to claim 5, further comprising a cooling unit disposed in the second housing and configured to cool the sheet passing through the fixing unit, wherein the supporting frame supports the cooling unit.

7. The image forming apparatus according to claim 6, wherein the circuit board is disposed downstream from the cooling unit in a sheet conveyance direction of conveyance by the cooling unit.

8. The image forming apparatus according to claim 6, wherein the cooling unit has a pair of conveyance belts for conveying the sheet, a heat sink in contact with an inner circumferential surface of a conveyance belt, and a cooling fan for cooling the heat sink, and wherein the cooling fan is disposed more rearward than the rear sheet metal in the front-back direction.

9. The image forming apparatus according to claim 5, further comprising a fixing exhaust fan disposed more rearward than the rear sheet metal in the front-back direction, and configured to discharge air present near the fixing unit to outside of the image forming apparatus.

10. The image forming apparatus according to claim 1, wherein the duct includes:

a first duct having the intake and disposed such that the first duct passes through the opening, a box configured to accommodate the circuit board therein, connected to the first duct, and disposed downstream from the first duct in the air flow, a second duct having the outlet, connected to the box, and disposed downstream from the box in the air flow.

11. The image forming apparatus according to claim 10, wherein a position of the second duct is higher than a position of the first duct such that a position of the exhausting port is higher than a position of the intake in a vertical direction.

12. The image forming apparatus according to claim 11, wherein the box is disposed between the first duct and the second duct in the vertical direction.

13. The image forming apparatus according to claim 10, wherein the fan is disposed inside the second duct.

14. The image forming apparatus according to claim 1, wherein the circuit board is a power source to drive the sheet conveying unit.

15. The image forming apparatus according to claim 5, wherein the circuit board is a power source to drive the sheet conveying unit.

16. The image forming apparatus according to claim 6, wherein the circuit board is a power source to drive the sheet conveying unit and the cooling unit.

* * * * *